United States Patent [19]

Suzuki

[11] Patent Number: 4,876,937

[45] Date of Patent: Oct. 31, 1989

[54] APPARATUS FOR PRODUCING RHYTHMICALLY ALIGNED TONES FROM STORED WAVE DATA

[75] Inventor: Hideo Suzuki, Shizuoka, Japan

[73] Assignee: Yamaha Corporation, Hamamatsu, Japan

[21] Appl. No.: 277,418

[22] Filed: Nov. 29, 1988

Related U.S. Application Data

[63] Continuation of Ser. No. 34,350, Apr. 3, 1987, abandoned, which is a continuation of Ser. No. 649,431, Sep. 11, 1984, abandoned.

[30] Foreign Application Priority Data

Sep. 12, 1983 [JP] Japan ..... 58-167765
Sep. 12, 1983 [JP] Japan ..... 58-167766

[51] Int. Cl.[4] ..... G10H 1/40; G10H 7/00

[52] U.S. Cl. ..... 84/612; 84/DIG. 12; 84/DIG. 22

[58] Field of Search ..... 84/1.01, 1.03, DIG. 12, 84/DIG. 22

[56] References Cited

U.S. PATENT DOCUMENTS 4,162,644 7/1979 Sakashita ..... 84/DIG. 12
4,186,639 2/1980 Robinson et al. ..... 84/DIG. 12
4,217,804 8/1980 Yamaga ..... 84/1.03
4,217,806 8/1980 Sakai et al. ..... 84/DIG. 12
4,275,634 6/1981 Imamura et al. ..... 84/1.03
4,424,731 1/1984 Howell ..... 84/DIG. 12

*Primary Examiner*—Stanley J. Witkowski
*Attorney, Agent, or Firm*—Spensley, Horn, Jubas & Lubitz

[57] ABSTRACT

An automatic tone producing apparatus produces tones at a rhythmic alignment by reading a memory which stores a train of tones of various instruments aligned in sequence to be respectively sounded at different time points to constitute a predetermined length of musical progression. The alignment intervals are irrelevant to the rhythm to be reproduced. The memory includes a plurality of memory areas which are alotted to and store the respective tones, and each of the memory areas is comprised of memory portions to store wave sample data of the each alotted tone. The memory areas to be read out are sequentially designated at a rhythmic pattern of a selected tempo, and the wave sample data within the designated memory area are read out at a predetermined speed independent of the tempo. Thus the tones having live sound properties are produced at various tempos but retaining the pitches of the respective tones.

15 Claims, 23 Drawing Sheets

APPARATUS FOR PRODUCING RHYTHMICALLY ALIGNED TONES FROM STORED WAVE DATA

This is a continuation of copending application Ser. No. 34,350, filed on Apr. 3, 1987, now abandoned, which was in turn a continuation of Ser. No. 649,431, filed on Sept. 11, 1984, now abandoned.

BACKGROUND OF THE INVENTION (a) Field of the invention:

The present invention pertains to an apparatus for automatically producing rhythmically aligned tones by reading out stored waveshape data of a train of tones, and more particularly it relates to an apparatus for producing rhythmically aligned tones with live sound properties from stored waveshape data of a train of tones at various tempos but retaining the pitches of the respective tones.

(b) Description of the prior art:

Recently, in apparatuses designed for automatically producing tones such as automatic rhythm apparatuses and automatic accompaniment apparatuses, there has been adopted, for the purpose of improving the produced tone quality, a method of reproducing tones by preliminarily storing the entire waveshape of a single tone for each individual musical instrument by means of PCM (Pulse Code Modulation) recording, and by reading out the stored waveshape data in accordance with, for example, rhythm timing pulses (see, for example, U.S. Pat. No. 4,305,319). Also, there has been known the technique of storing, in a memory, the entire waveshape of a tone from the rise until the extinction thereof for each discrete musical instrument, and of reproducing the tones of the musical instruments by reading the stored waveshape data out of the memory in accordance with sounding commands (see, for example, Japanese Patent Preliminary Publication No. Sho 52-121313). In case such technique as these is applied to an automatic accompaniment apparatus of such as automatic chord, automatic arpeggio and automatic bass, it is possible to make the individual accompaniment tones which are produced in accordance with the accompaniment patterns resemble the tones of natural musical instruments. These methods have the drawback such that, because the occasionally (from-time-to-time) reproduced tones of a same musical instrument are all generated by reading-out the same single waveshape data for the entire tone, the tone quality of these produced tones as a same instrument are always uniform, and that therefore, it is impossible to reproduce subtle difference in tone quality with respect to the progression of the rhythm and/or in the relationship with other participating musical instruments, and that, thus, good performance with live sound properties can hardly be obtained.

Also, there has been proposed an automatic rhythm apparatus arranged so that those tones of respective rhythm-producing instruments which .have been produced successively to constitute each kind of are recorded on a magnetic tape, and that the recorded tones of these rhythm-producing instruments are repetitively reproduced (for example, see Japanese Patent Preliminary Publication No. Sho 49-59622). This apparatus, while there is obtained a pretty good live performance effect, is entailed by the drawback that alteration of tempo brings about a change in the pitches of the reproduced tones.

There has been known the technique that, when reproducing voice signals recorded on a magnetic tape, several cycles of the waveshape of a tone are blanked out periodically, and the respective sample values of the remaining waveshape are delayed for a desired length of time to enable alteration of the tempo while unchanging the pitch of the tone (see, for example, U.S. Pat. No. 3,786,195). When this latter-mentioned technique is adopted in the above-stated automatic rhythm apparatus using a magnetic tape, it becomes possible to alter the tempo without changing the pitch. However, because the portion at which the waveshape is blanked out is determined at a constant cycle irrespective of the tone producing timing, there could occur that the very rise (build-up) portion of the waveshape which is most critical for the tone quality is cancelled out, brings the inconvenience that the tone quality is extremely degraded.

Also, the problems which require solution when materializing a digital recording type automatic accompaniment apparatus of this kind lie, in the first place, in that the tempo can be altered without being entailed by pitch-changing or degradation of tone quality, and in the second place in minimizing the capacity of the waveshape data memory.

SUMMARY OF THE INVENTION

It is, therefore, an object of the present invention to provide a new tone producing apparatus which can alter tempo without being accompanied by a change in pitches of the tones, and which is capable of displaying a live sound performance effect.

Another object of the present invention is to provide a tempo-variable chord accompaniment apparatus which is capable of providing a live sound performance effect with a minimized memory capacity.

In order to attain the above objects, the tone producing apparatus according to the present invention comprises: memory means storing a train of tones of various instruments aligned in sequence to be successively sounded at different time points to constitute a predetermined length of musical progression but aligned at intervals irrelevant to rhythmic timings of the tones to be produced, said memory means including a plurality of memory areas which are alotted to and store said tones respectively, each of said memory areas being comprised of memory portions to store wave sample data of the allotted tone; area designating means for sequentially designating areas to read out said train of tones in a timewise pattern to constitute the musical progression having a tempo; read-out speed determining means for determining a speed of reading said wave sample data out of said memory portions within said designated area; and read-out means for reading out said wave sample data from said memory portions in the area designated by said area designating means at the speed determined by said read-out speed determining means.

According to one aspect of the present invention, there is provided means for adjusting waveshape data relating to successive tones read out of the memory, whereby the connecting configuration of the successive tones is modified into a musically desirable one.

According to another aspect of the present invention, a plurality of groups of waveshape data are stored in the memory corresponding to a plural number of tempo range sections, and a group of waveshape data which is to be read out of the memory is selected in accordance with the set tempo.

According to yet another aspect of the present invention, a plurality of groups of waveshape data for the chord tones are stored in the memory corresponding to a plural tone compasses respectively, and a group of waveshape data to be read out from this memory is selected in accordance with the root note of a designated chord.

BRIEF DESCRIPTION OF THE DRAWINGS

FIGS. 15A and 15B are time charts for explaining the accompaniment tone producing operations which differ from each other in their address controlling patterns, in which:

FIG. 15A shows the instance involving skipping of addresses for a quick tempo, and FIG. 15B shows the instance involving halting of the advancement of address for a slow tempo.

DETAILED DESCRIPTION OF THE PREFERRED EMBODIMENTS

First Embodiment

Figure 1A:
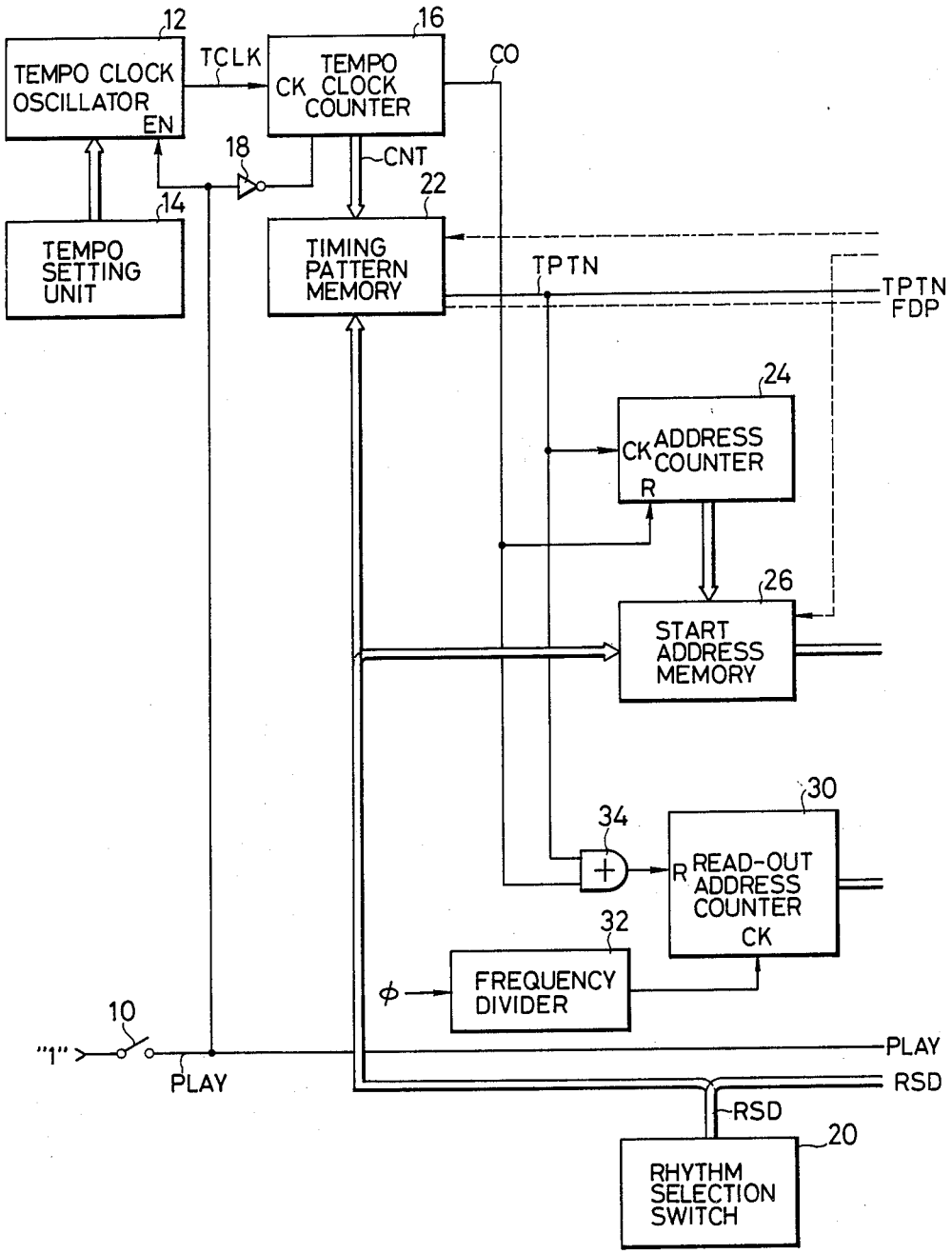
FIGS. 1A and 1B in combination are a block diagram showing an automatic rhythm tone producing apparatus representing a first embodiment of the present invention.
Figure 1B:
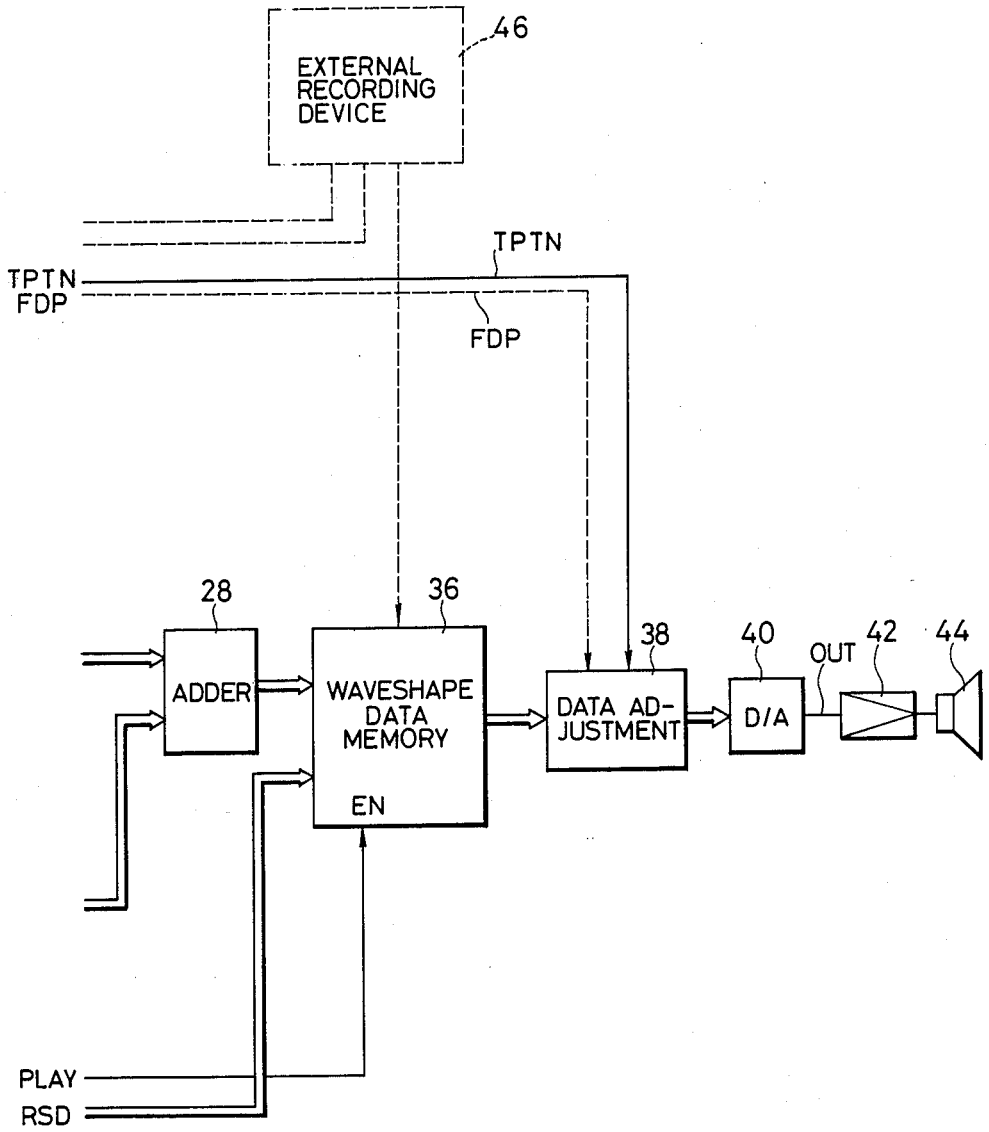

FIGS. 1A and 1B show an automatic rhythm tone producing apparatus representing the first embodiment of the present invention.

A start-stop control switch 10 is designed to be turned on and off at the time a rhythm is started and stopped, respectively, and it is connected to a "1" signal supply. When the control switch 10 is turned on, a play mode signal PLAY is rendered to "1" as shown in FIG. 2.

Figure 2:
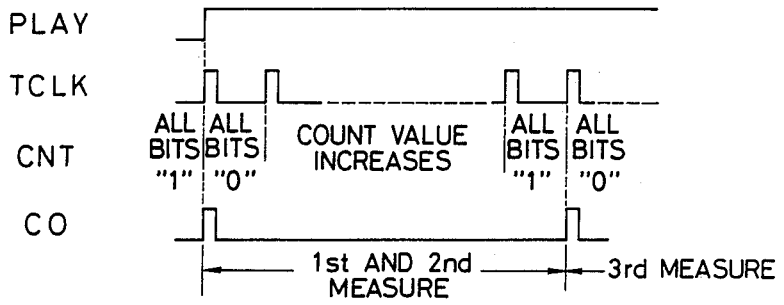
FIG. 2 is a time chart for explaining the operation of the tempo counter in the apparatus of FIGS. 1A and 1B.

A tempo clock oscillator 12 is arranged so that, when the play mode signal PLAY becomes "1", it is rendered to the enabled state and generates tempo clock pulses TCLK as shown in FIG. 2.

A tempo setting unit 14 contains a knob which is operated by, for example, manipulation to set a desired tempo, and is arranged to supply, to the tempo clock oscillator 12, tempo controlling data indicative of a set tempo. The frequency of the tempo clock pulse TCLK which is generated from the tempo clock oscillator 12 is controlled in accordance with the tempo controlling data delivered from the tempo setting unit 14, and is determined in accordance with the set tempo.

A tempo clock counter 16 is comprised of flip-flops having stages corresponding to the length of, for example, two measures, and is arranged to generate a count output CNT and a carry-out pulse CO by counting tempo clock pulses TCLK. This tempo clock counter 16 is set in such a way that, before the control switch 10 is turned on, all bits of the count output CNT are "1" in accordance with the output signal "1" of an inverter 18 which receives a play mode signal PLAY="0". And, when the play mode signal PLAY becomes "1" in accordance with the turn-on operation of the control switch 10, the tempo clock counter 16 is so constructed that it generates a carry-out pulse CO when all the bits of the count output CNT assume "0" state in response to the initial tempo clock pulse TCLK delivered from the tempo oscillator 12.

Thereafter, the tempo clock counter 16 successively counts the second and subsequent tempo clock pulses TCLK, and successively augments its count value. When the tempo clock counter 16 counts tempo clock pulses for two measures (first and second measures), all bits of the count output CNT become "1". And, the tempo clock counter 16 is so constructed that when all bits of its count output CNT assume "0" state as shown in FIG. 2 in response to the initial tempo clock pulse TCLK of the third measure, it generates a second carry-out pulse CO. Thereafter, sequential counting operations as mentioned above are repeated, and sequential count outputs CNT are repetitively generated from the tempo counter 16, and a carry-out pulse CO is generated after every lapse of two measures.

A rhythm selection switch circuit 20 contains rhythm selection switches corresponding to respective kinds of rhythms such as bossanova, march, waltz, rumba and swing, and is arranged so that, in accordance with a rhythm selection operation by these rhythm selection switches, it delivers out a rhythm type designation data RSD indicative of the selected type (kind) of rhythm.

A timing pattern memory 22 stores, for each type (kind) of rhythm, a timing pattern indicative of the sounding timings of generating successive percussion tones of various instruments in a line. To this memory is supplied a rhythm type designation data RSD from the rhythm selection switch circuit 20 as a static address designation signal which is to select a line of memory area storing the designated rhythm pattern of a two-measure period, and concurrently therewith it is supplied, from the tempo clock counter 16, with a count output CNT as a dynamic address designation signal which is to pick up timing pulses from the designated line of memory area.

When a specific type of rhythm is designated by virtue of the rhythm type designation data RSD, the timing pattern corresponding to the designated type of rhythm is repetitively read out in accordance with the count output CNT. As a result, sequential timing pulses TPTN are delivered out from the timing pattern memory 22 in accordance with the timing pattern of the designated type of rhythm.

An address counter 24 receives a timing pulse TPTN as a clock input CK, and concurrently therewith it also receives a carry-out pulse CO as its reset input R. Arrangement is provided so that, when both the clock input CK and the reset input R are supplied thereto simultaneously, the reset input R will act preferentially. The tempo clock counter 16 is set in such a way that, before the control switch 10 is turned on, all bits of the count output CNT thereof will become "1" in accordance with the output signal "1" of the inverter 18 which receives the play mode signal PLAY="0". And, when the control switch 10 is turned on as stated above, an initial carry-out pulse CO is generated from the tempo clock counter 16. After the address counter 24 is reset in accordance with this initial carry-out pulse CO, this counter 24 counts timing pulses TPTN sequentially, and supplies, to a start address memory 26, its count output (increasing by a step of "1") as a dynamic address designation signal which is to read start address numbers one after another.

The start address memory 26 stores, for each type of rhythm mentioned above, start address data indicative of read-out start addresses (in the waveshape data memory) for those respective percussion tones which are to be generated sequentially to constitute the type of rhythm. To this memory 26 is supplied, from the rhythm selection switch circuit 20, rhythm type designation data RSD as a static address designation signal which is to select a line of memory area storing a train of start address numbers for the designated rhythm.

When a specific type of rhythm is designated by virtue of the rhythm type designation data RSD, start address data corresponding to the designated type of rhythm are read out sequentially in accordance with the count output of the address counter 24, and the data is supplied to an adder circuit 28.

A read-out address counter 30 is intended to count output pulses of a constant frequency delivered from a frequency divider 32 which divides the frequency of a system clock signal $\phi$, and to sequentially generate an address signal so as to indicate the address value which progresses at a constant speed, and is arranged to be reset in accordance with either a carry-out pulse CO or a timing pulse TPTN from an OR gate 34. When the control switch 10 is turned on, the OR gate 34 generates an initial output signal "1" in accordance with the initial carry-out pulse CO and with the initial timing pulse TPTN. After the read-out address counter 30 is reset in accordance with the initial output signal "1" delivered from the OR gate 34, it sequentially counts up the output pulses delivered from the frequency divider 32 and delivers increasing numbers until it is reset by the second timing pulse TPTN, and thereafter it repeats similar count-reset operations. And, after the completion of the second measure, the read-out address counter 30 is reset by the second carry-out pulse CO. Thereafter, such count-reset operations as mentioned above are repeated in a similar way. The constant speed read-out address signal which is delivered out from the read-out address counter 30 is supplied to the adder circuit 28.

The adder circuit 28 adds the start address data delivered from the start address memory 26 and the address signal delivered from the read-out address counter 30, and its sum output is supplied, as a waveshape data read-out address signal, to a waveshape data memory 36.

The waveshape data memory 36 stores, for each type of rhythm mentioned above, waveshape data indicative of a train of waveshapes of percussion tones of various instruments in a line which is to be generated sequentially at respective proper timings to constitute the rhythm. As the stored waveshape data, there are used digital waveshape data for two measures comprised of digital words indicative of the sample values of waveshapes for the respective percussion tones. Such digital waveshape data are obtained by recording actual rhythm performance by an instrument player, and by sampling the recorded signals at a certain sampling rate, and by subjecting the respective sample values to analog/digital (A/D) conversion.

The waveshape data memory 36 is supplied, from the rhythm selection switch circuit 20, with rhythm type designation data RSD as a static address designation signal which selects a line of memory area storing a train of tones (waveshape data) for the designated rhythm, and is arranged so that the train of waveshape data which are to be read out is selected in accordance with the selected type of rhythm. When the play mode signal PLAY becomes "1" in accordance with the turn-on operation of the control switch 10, the waveshape data memory 36 is rendered to the enabled state. In this state, each set of waveshape data constituting a tone in the selected data train corresponding to the selected type of rhythm is accessed in accordance with each start address data and is read out at a constant speed within the set (for each percussion tone) in accordance with the address signal supplied from the adder circuit 28.

Waveshape data of the sequential percussion tones read out from the waveshape data memory 36 are supplied to a data adjustment circuit 38. This data adjustment circuit 38 is intended to adjust the waveshape sample value to render the waveshape connection configuration of the sequential percussion tone into a preferable style, the details of which will be described later.

The waveshape data of the sequential percussion tones which are delivered out from the data adjustment circuit 38 is supplied to a digital/analog (D/A) converter circuit 40 to be converted to analog percussion tone signals OUT. And, those percussion tone signals OUT which are delivered out sequentially from the D/A converter circuit 40 are supplied, via an output amplifier 42, to a loudspeaker 44 to be converted to percussion tones. Accordingly, automatic rhythm tones are sounded out from the loudspeaker 44.

Rhythm Tone Producing Operation

Figure 3:
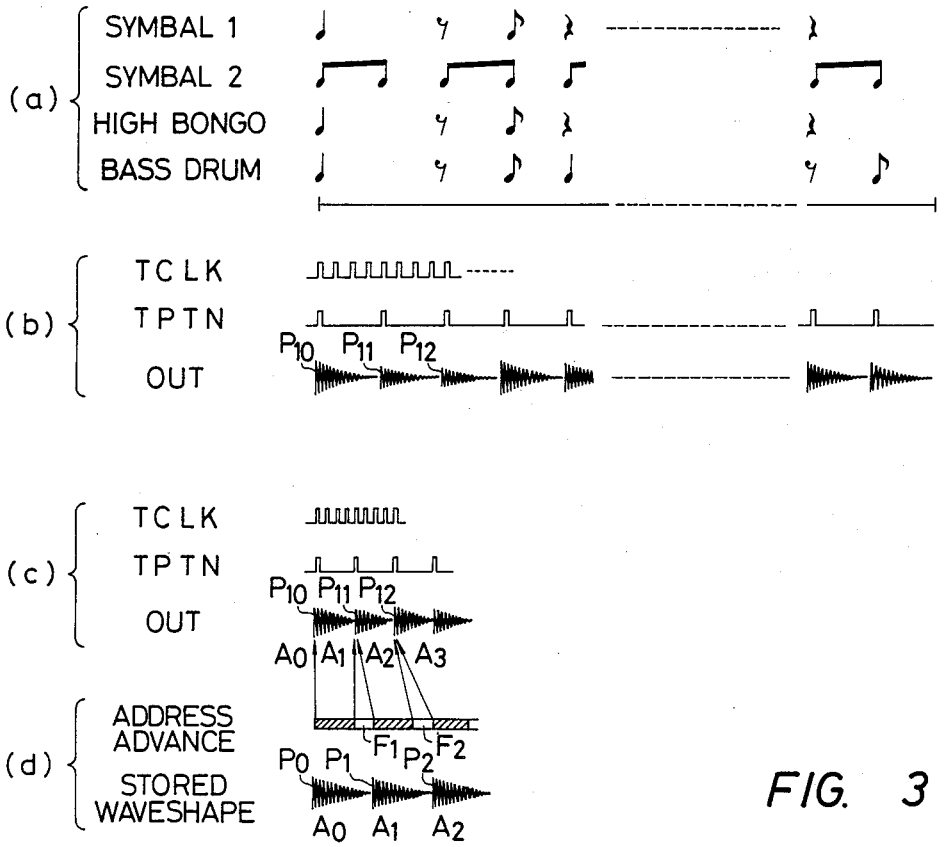
FIG. 3 is a time chart for explaining the rhythm tone producing operation of the apparatus of FIGS. 1A plus 1B.

Here, reference is made to FIG. 3, to explain one example of the rhythm tone producing operation with respect to the instance wherein bossanova is selected in the rhythm selection switch circuit 20.

FIG. 3(*a*) shows a partly omitted musical score for two measures concerning a bossanova rhythm. This rhythm is arranged to be performed by percussion instruments using cymbal 1, cymbal 2, high conga and bass drum. It should be noted here that the train of tones includes tones of various different instruments aligned in a line and that some tones are of simultaneous sounding of different instruments.

FIG. 3(*d*) shows, in the form of analog signals for the sake of convenience, the waveshape data stored in the waveshape data memory 36. $P_0$, $P_1$, $P_2$, . . . show sets of waveshape data corresponding to the first, second, third, . . . percussion tones, respectively. $A_0$, $A_1$, $A_2$, . . . show the read-out start addresses for the sets $P_0$, $P_1$, $P_2$, . . . , respectively. Each set of waveshape data constituting each percussion tone comprises numerous digital words indicative of the sample values of contiguous waveshape of the tone from its rise to immediately before the rise of the next tone. The waveshape data set $P_0$ corresponding to the first percussion tone represents the waveshape of mixed tones obtained when cymbal 1, cymbal 2, high conga and bass drum are sounded simultaneously. Whereas, the waveshape data set $P_1$ and $P_2$ corresponding to the second and third percussion tones both represent the waveshape of the solo tone of cymbal 2, as will be understood from the rhythm chart of FIG. 3(*a*). The automatic rhythm tone producing apparatus of this embodiment is so constructed that it allows quickening of the reproduction tempo, but not slowing down of this tempo, and therefore the waveshape data $P_0$, $P_1$, $P_2$, . . . are recorded preliminarily in a slower tempo.

FIG. 3(*b*) shows the operation in the instance wherein the rhythm tones are produced at a tempo same as that at recording. FIG. 3(*c*) shows the operation in the instance wherein the rhythm tones are produced at a tempo faster than in the case of FIG. 3(*b*).

In the case of FIG. 3(*b*), when the control switch 10 is turned on after the tempo is set in the tempo setting unit 14 at a tempo same as recording tempo, the tempo clock oscillator 12 generates tempo clock pulses TCLK at a frequency corresponding to the set tempo. As described above, the tempo clock counter 16 generates an initial carry-out pulse CO in accordance with the initial tempo clock pulse TCLK. Also, simultaneously therewith, all bits of the count output CNT become "0", and in accordance therewith, the timing pattern memory 22 commences the generation of timing pulses TPTN in accordance with the timing pattern of bossanova.

The initial carry-out pulse CO and the initial timing pulse TPTN are both inputted to the address counter 24 substantially at the same time. However, as stated above, since reset supersedes, the address counter 24 is reset in accordance with the initial carry-out pulse CO, and its count output becomes "0" for all bits. Accordingly, from the start address memory 26 is read out a start address data indicative of the read-out start address $A_0$ of the waveshape data set $P_0$ corresponding to the first percussion tone of bossanova.

Also, the initial carry-out pulse CO and the initial timing pulse TPTN are inputted to the OR gate almost simultaneously. In accordance therewith, the OR gate 34 generates the initial output signal "1". This initial output signal "1" serves to reset the read-out address counter 30, so that the count output of this counter 30 becomes "0" for all bits. Thereafter, the read-out address counter 30 sequentially counts the output pulses delivered from the frequency divider 32, and delivers out an address signal which increases sequentially. As a result, there are generated successively, from the adder circuit 28, address signals in such a manner as to indicate the address value which increases (progresses) at a constant speed from the read-out start address $A_0$. In response thereto, there are successively read out waveshape data set $P_0$ corresponding to the first percussion tone.

The set of waveshape data read out from the waveshape data memory 36 are supplied, via the data adjustment circuit 38, to the D/A converter circuit 40. Therefore, there is generated, as a percussion tone signal OUT, from the D/A converter circuit 40 a percussion tone signal $P_{10}$ corresponding to the first percussion tone. This percussion tone signal $P_{10}$ contains mixed tones of cymbal 1, cymbal 2, high conga and of bass drum.

When, thereafter, the second timing pulse TPTN is generated from the timing pattern memory 22, the count value of the address counter 24 becomes 1 (one). In accordance therewith, there is read out from the start address memory 26 a start address data indicative of a read-out start address $A_1$. Also, the read-out address counter 30, after being reset in accordance with the second timing pulse TPTN, successively counts the frequency-divided output pulses and generates address signals successively in the same manner as in the preceding instance.

As a result, there is read out, from the waveshape data memory 36, waveshape data $P_1$ corresponding to the second percussion tone successively at a constant speed. In response thereto, percussion tone signal $P_{11}$ corresponding to the second percussion tone is generated from the D/A converter circuit 40. This percussion tone signal $P_{11}$ includes the solo tone of cymbal 2.

Thereafter, each time a timing pulse TPTN is generated, there is performed sequential waveshape data read-out operation in the same way as described above, and there are generated successively from the D/A converter circuit 40 the third and onward percussion signals such as $P_{12}$.

Upon completion of the reading-out of the waveshape data for two measures, the tempo clock counter 16 generates the second carry-out pulse CO, and resets both the address counter 24 and the read-out address counter 30. As a result, for the next two measures also, waveshape data concerning the successive percussion tone are read out in the similar way as described above. In accordance with the read-out data, percussion tone signals are generated in succession, and thereafter similar operations are repeated. Accordingly, from the loudspeaker 44 are produced, based on the stored waveshape data for the two measures, automatic rhythm tones of bossanova, at the same tempo as that at the time of recording.

Next, description will be made of the operation of the instance wherein the tempo is quickened, by referring to FIG. 3(*c*). In this case, a desired quick tempo is set by the tempo setting unit 14. By doing so, the frequency of the tempo clock pulse TCLK is elevated. In accordance with this elevation of frequency, the pulse intervals of the timing pulses TPTN becomes shorter. As a result, the advancement of address as viewed at the output side of the adder circuit 28 becomes such that address is skipped at such portions as $F_1$ and $F_2$ as shown in FIG. 3(*d*). The waveshape data corresponding to these skipped addresses are not read out from the waveshape data memory 36.

More specifically, the initial percussion tone signal $P_{10}$ is generated based on that very waveshape data read out in accordance with the advancement of address between the initial and the second timing pulses TPTN among the waveshape data $P_0$, and the second percussion tone signal $P_{11}$ is generated based on the waveshape data read out in accordance with the advancement of address between the second and third timing pulses TPTN among the waveshape data $P_1$, and the percussion tone signals such as $P_{12}$ and subsequent signals are generated also in a similar way. As a result, the respective percussion tones will be reproduced in such a form that a part of the decay waveshape is blanked out. However, the waveshape of the rise portion which is important for music tones is faithfully reproduced, and therefore there is practically no problem. Also, even when tempo is quickened, the frequency of the output pulses of the frequency divider 32 does not change, so that the read-out speed of the waveshape data does not change either. Accordingly, the pitches of the reproduced percussion tones will not change in accordance with the altered tempo.

In case an automatic rhythm is intended to be halted, the control switch 10 is turned off. Whereupon, the tempo clock oscillator 12 and the waveshape data memory 36 are rendered to the disabled state, and thus the reading-out of waveshape data comes to a halt. As a result, the automatic rhythm stops, too. Also, in case it is intended to generate an automatic rhythm other than bossanova, a desired type of rhythm is selected by means of the rhythm selection switch circuit 20. Whereupon, the automatic rhythm tone concerning the selected type of rhythm is sounded out in the same manner as described above.

Data Adjustment Circuit

The data adjustment circuit 38 is comprised of, for example, an amplitude controlling circuit. In such a case, the timing pattern memory 22 is operated to preliminarily store a timing pattern intended for generating a decay start timing pulse FDP at a timing preceding by a required length of time T which is about several milliseconds relative to each of the second and onward respective timing pulses TPTN, as shown in FIG. 4.

Figure 4:
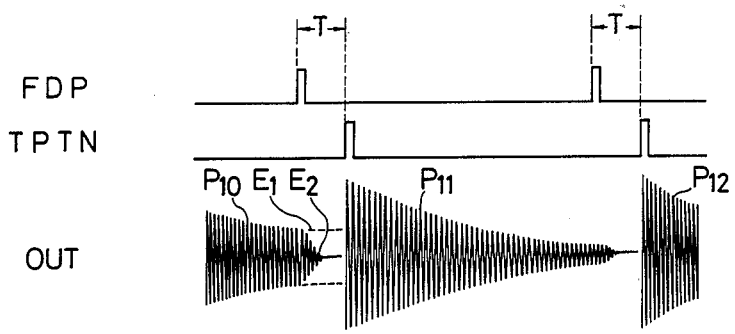
FIG. 4 is a time chart showing an example of adjustment of wave sample values by using an amplitude controlling circuit.

In case the tempo is slowed down as described above, there could happen that the second percussion tone signal $P_{11}$ is generated in accordance with the second timing pulse TPTN when the initial percussion tone signal $P_{10}$ is still decaying slowly in accordance with the envelope $E_1$ as shown in FIG. 4. In such case, if there is a large difference between the sample value indicated by the waveshape data read out initially in accordance with the second timing pulse TPTN and the sample value indicated by the waveshape data read out immediately therebefore, there could develop a click noise. The data adjustment circuit 38 is intended to be provided to prevent the occurrence of such a click noise.

The amplitude controlling circuit which constitutes the data adjustment circuit 38 commences a multiplication of the waveshape data with the decay envelope data in accordance with the decay start timing pulse FDP which precedes the second timing pulse TPTN. This multiplication processing is performed so as to reduce, by relying on, for example, the bit shift method, the waveshape sample value by ½ at a time, and is brought to a halt with the arrival of the second timing pulse TPTN. As a result, the initial percussion tone signal is forced to decay in accordance with the envelope $E_2$, whereby the development of a click noise is prevented. Such a forced decay control is similarly applied also to the waveshape data corresponding to the second and subsequent respective percussion tones. It should be noted here that the decay control may be carried out in such a way that the greater the detected amplitude level is, the greater will be made the decay rate.

The data adjustment circuit 38, in another example, is comprised of a waveshape interpolation circuit. The waveshape interpolation circuit has a register for always preserving past seven (7) sample values and adjusts fourteen (14) sample values starting at the generation of each timing pulse TPTN by carrying out the operation of the below-mentioned formulas (1) and (2).

$$1 \leqq i \leqq 7 \quad C_i = \frac{\sum_{j=1}^{8-i} A_j + \sum_{k=1}^{i} B_k}{8} \tag{1}$$

$$8 \leqq i \leqq 14 \quad C_i = \frac{\sum_{k=2i-15}^{i} B_k}{16-i}. \tag{2}$$

Figure 5:
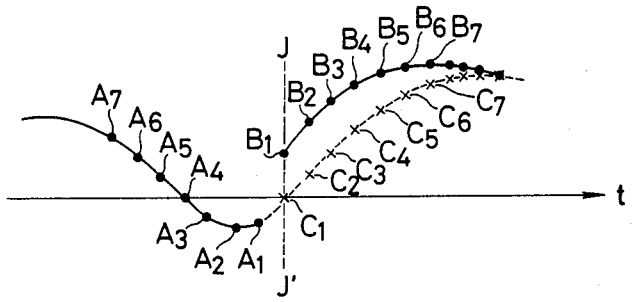
FIG. 5 is a waveshape diagram showing an example of adjustment of wave sample values by using a interpolation circuit.

In these formulas (1) and (2), $A_j$, $B_k$ and $C_i$ are wave sample values in the neighborhood of the waveshape junction line J–J′ as shown in FIG. 5. In FIG. 5, $A_1 \sim A_7$ represent the sample values before the junction line; $B_1 \sim B_{14}$ represent the sample values after the junction line; and $C_1 \sim C_{14}$ represent the adjusted sample values, respectively. In FIG. 5, the horizontal axis indicates time t, and illustration of $B_8 \sim B_{14}$ and $C_8 \sim C_{14}$ is omitted.

According to formula (1) shown above, the adjusted sample value $C_1$ for example is obtained by dividing, by eight (8), the added value of the sum of the sample values $A_1 \sim A_7$ and the sample value $B_1$. The adjusted sample value $C_7$ is obtained by dividing, by eight (8), the added value of the sample value $A_1$ and the sum of the sample values $B_1 \sim B_7$. In this way, $C_1 \sim C_7$ can be obtained by taking the average of eight (8) sample values locating before and after the junction line J—J′.

Also, according to formula (2) shown above, the adjusted sample value $C_8$ for example is obtained by dividing, by eight (8), the sum of the sample values $B_1 \sim B_8$. The adjusted sample value $C_{14}$ is obtained by dividing, by two (2), the sum of the sample values $B_{13}$ and $B_{14}$. In this way, $C_8 \sim C_{14}$ are obtained by averaging the values of samples of progressively reducing numbers so as to progressively reduce the influence of the past sample values.

By using the above-described waveshape interpolation circuit, those waveshapes which have been discontinuous at the waveshape junction line J–J′ are rendered to be substantially continuous, and thus it is possible to prevent the occurrence of a click noise.

It should be noted here that, in the embodiment of FIGS. 1A and 1B, arrangement has been provided so that an automatic rhythm is repeated by every two measures. The arrangement may be modified so that repetition of automatic rhythm takes place by each single measure or any other desired areas of score. Also, the timing pattern memory 22, the start address memory 26 and the waveshape data memory 36 may each be comprised of RAM (Random Access Memory) so as to transfer necessary data to these respective memories 22, 26 and 36 from external recording unit 46 such as a floppy disk and a magnetic tape.

Second Embodiment

Figure 6A:
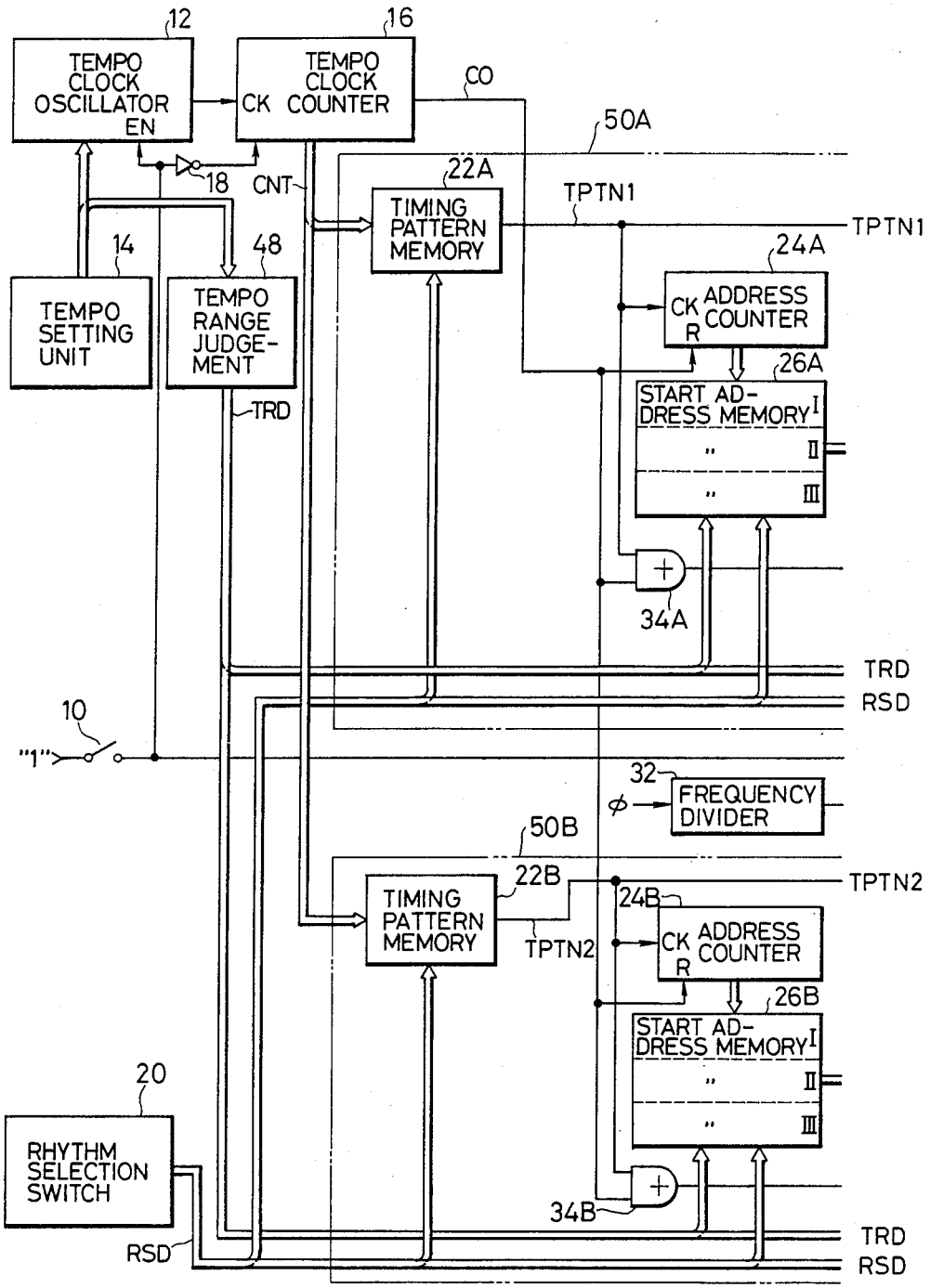
FIGS. 6A and 6B in combination are a block diagram showing an automatic rhythm producing apparatus representing a second embodiment of the present invention.
Figure 6B:
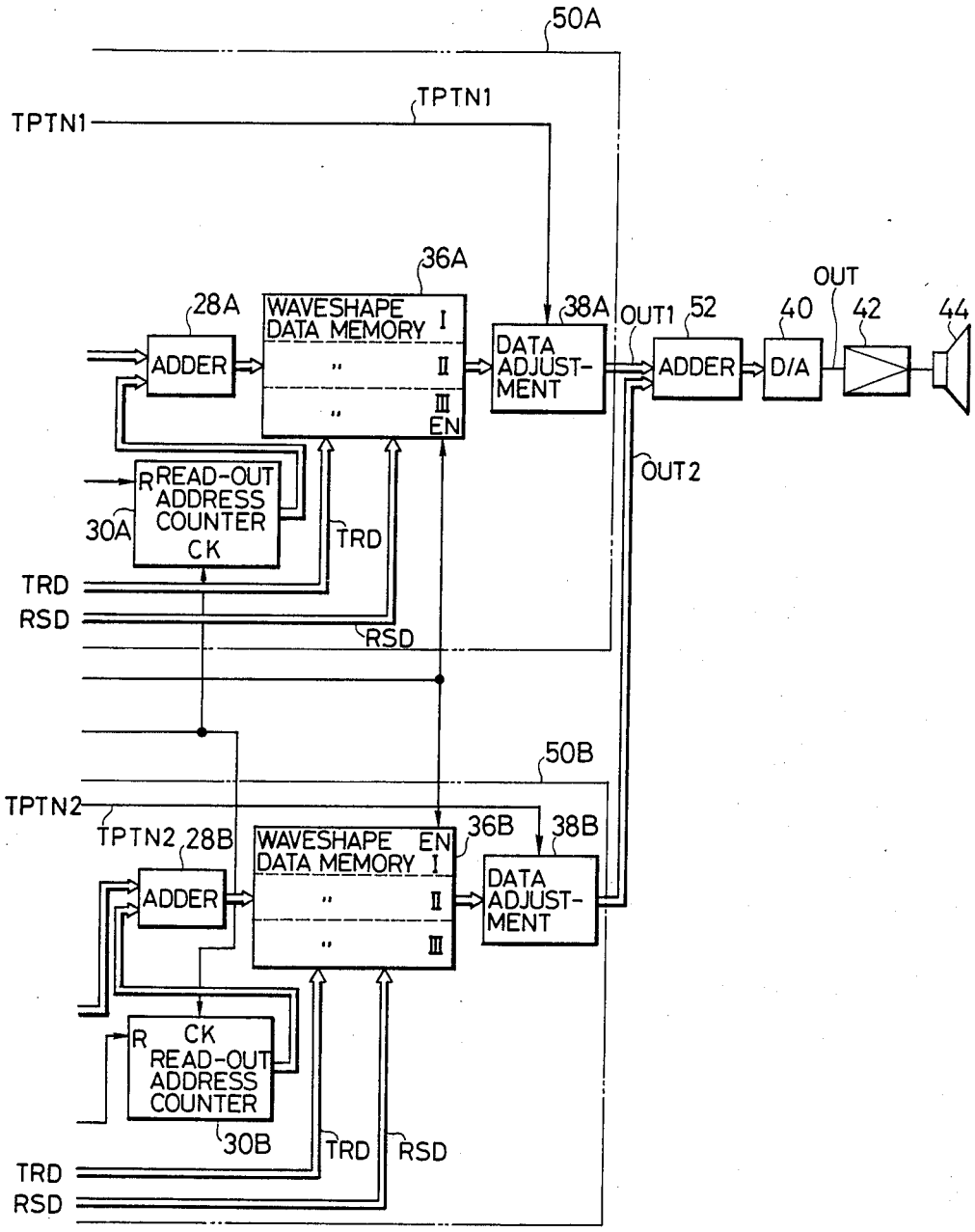

FIGS. 6A and 6B show in combination an automatic rhythm tone producing apparatus according to the second embodiment of the present invention like parts as in FIGS. 1A and 1B are given like reference numerals as in FIGS. 1A and 1B.

The apparatus of FIGS. 6A and 6B has two features. The first one represents the arrangement that, in view of the inconvenience which arises, when the range of variability of tempo becomes wide, this leads to the presence of larger blanked-out portions of waveshapes, and causes degradation of tone qualities, the range of variability of tempo is sub-divided into a plurality of range sections (sub-ranges) so that waveshape data are stored and read out for each tempo range section. Also, the second feature represents the arrangement to perform the storage and reading-out of waveshape data separately for each length of envelope in view of the fact that, when recording is made in the form that the tones of a plurality of musical instruments are mixed, blanked out portions of waveshapes for such percussion tones having long envelopes such as of timpani, tam-tam and conga will be so great that the tone qualities would naturally become degraded.

A tempo range judgement circuit 48 is to judge to which one of the three predetermined tempo range section I, II and III the tempo set by the tempo setting unit 14 belongs, and is arranged to deliver out a tempo range designation data TRD indicative of the tempo range section thus judged. In case, for example, the range of variability of tempo is 60–200 in terms of the number of quarter notes per minute, it is possible to demarcate this range into the following three tempo range sections I, II and III, i.e. 60~99, 100~149 and 150~200.

The first storage and read-out line 50A is intended for those percussion tones having relatively short envelopes, and the second storage and read-out line 50B is intended for percussion tones having relatively long envelopes. In these first and second storage and read-out lines 50A and 50B, those blocks indicated by reference numerals added with "A" or "B" are to be understood to possess functions substantially identical with those of the blocks in FIGS. 1A and 1B provided with corresponding reference numerals.

In the first storage and read-out line 50A, the timing pattern memory 22A stores, for each type of rhythm, a timing pattern indicative of the successive percussion tone generating timings having relatively short time intervals. This memory is supplied, as a static address designation signal, with rhythm type designation data RSD from the rhythm selection switch circuit 20. The timing pattern memory 22A delivers out successive timing pulses TPTN corresponding to the selected type of rhythm in accordance with the count output CNT delivered from the tempo clock counter 16.

The start address memory 26A has three storage sections corresponding to the tempo range sections I, II and III, respectively. Each storage section stores for each type of rhythm start address data for percussion tones having a short envelope which are generated successively at a tempo belonging to the corresponding tempo range section. The start address memory 26A is supplied, as a static address designation signal, with a tempo range designation data TRD and also with a rhythm type designation data RSD, and is arranged so that a group of start address data which are to be read out are determined in accordance with the set tempo and the selected type of rhythm.

The waveshape data memory 36A has three storage sections corresponding to the tempo range sections I, II and III, respectively. Each storage section stores, for each type of rhythm, waveshape data for percussion tones of short envelopes which are generated successively at a tempo belonging to the corresponding tempo range section. The waveshape data memory 36A is supplied, as static address designation signals, a tempo range designation data TRD and a rhythm type designation data RSD, and is arranged so that a group of waveshape data which are to be read out is determined in accordance with the set tempo and with the selected type of rhythm.

In the second storage and read-out line 50B, the timing pattern memory 22B stores, for each type of rhythm, a timing pattern which is indicative of successive percussion tone generating timings having relatively lengthy time intervals, and is supplied, as a static address designation signal, a rhythm type designation data RSD from the rhythm type selection switch circuit 20. The timing pattern memory 22B delivers out, in accordance with the count output CNT from the tempocounter 16, successive timing pulses TPTN corresponding to the selected type of rhythm.

The start address memory 26B has three storage sections corresponding to the tempo range sections I, II and III, respectively, and the respective storage sections store, for respective types of rhythm, start address data for long envelope percussion tones which are generated successively at a tempo belonging to the corresponding tempo range section. The start address memory 26B is supplied, as static address designation signals, a tempo range designation data TRD and a rhythm type designation data RSD, and is arranged so that a group of start address data which is to be read out are determined in accordance with the set tempo and with the selected type of rhythm.

The waveshape data memory 36B has three storage sections corresponding to the tempo range sections I, II and III, respectively. The respective storage sections store, for respective types of rhythm, waveshape data for long envelope percussion tones which are successively generated at a tempo belonging to the corresponding tempo range section. The waveshape data memory 36B is supplied, as static address designation signals, with a tempo range designation data TRD and with a rhythm type designation data RSD, and is arranged so that a group of waveshape data which are to be read out is determined in accordance with the set tempo and with the selected type of rhythm.

An adder circuit 52 is intended to carry out an addition of a waveshape data $OUT_1$ supplied, via the data adjustment circuit 38A, from the waveshape data memory 36A and a waveshape data $OUT_2$ supplied, via the data adjustment circuit 38B, from the waveshape data memory 36B. The addition output delivered from the adder circuit 52 is supplied to the D/A converter circuit 40 to be converted to a percussion tone signal OUT.

Rhythm Tone Producing Operation

Next, description will be made of the rhythm tone producing operation by the apparatus of FIGS. 6A and 6B by referring to FIG. 7.

Figure 7:
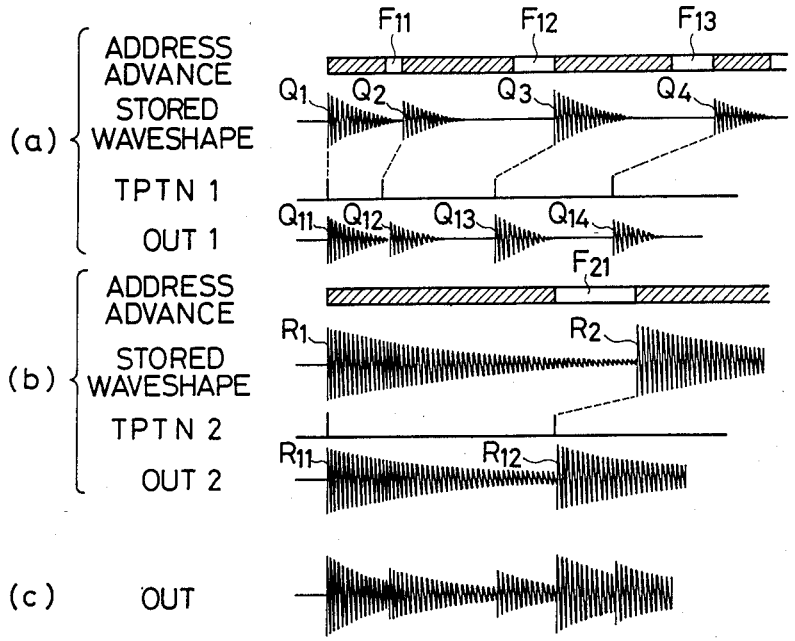
FIG. 7 is a time chart for explaining the rhythm tone producing operation of the apparats of FIGS. 6A plus 6B.

In the tempo setting unit 14, a quick tempo belonging to the tempo range section II is set as an example, and in the rhythm selection switch circuit 20, let us assume that a specific type of rhythm has been set to produce automatic rhythm tones which are expressed in the form of a combination of the stored waveshapes of (a) and (b) in FIG. 7. It should be noted here that the stored waveshapes of (a) and (b) in FIG. 7 illustrate, in the form of analog signals for the sake of convenience, those waveshape data stored in the waveshape data memories 36A and 36B, respectively.

When the control switch 10 is turned on, there is performed in the first storage and read-out line 50A, such a read-out operation as shown at (a) in FIG. 7, and in the second storage and read-out line 50B, a read-out operation as shown at (b) in FIG. 7 is performed.

That is, in the first storage and read-out line 50A, the timing pattern memory 22A reads out the timing pattern corresponding to the selected type of rhythm at the set quick tempo, whereby delivering out successive timing pulses $TPTN_1$. In accordance with such a generation of timing pulses as mentioned above, there are read out successively, from the start address memory 26A, start address data of respective waveshapes corresponding to the selected type of rhythm among the start address data of the storage section corresponding to the tempo range section II. As a result, there are read out successively from the waveshape data memory 36A those waveshape data $Q_1, Q_2, Q_3, Q_4, \ldots$ corresponding to the selected type of rhythm among the waveshape data of the storage section corresponding to the tempo range section II, at a read-out start timing synchronous with the timing of generating the timing pulse $TPTN_1$ and at a constant speed for each percussion tone. In this case, since a quick tempo is set, the advancement of address as viewed at the output side of the adder circuit 28A becomes such that the addresses for portions such as $F_{11}, F_{12}, F_{13}, \ldots$ are skipped, and thus the waveshape data corresponding to the skipped addresses are not read out.

The waveshape data read out from the waveshape data memory 36A is supplied, as the waveshape data $OUT_1$, to an adder circuit 52 via the data adjustment circuit 38A. In (*a*) of FIG. 7, the waveshape data $OUT_1$ is shown in the form of an analog signal for the sake of convenience. The percussion tone signals $Q_{11}, Q_{12}, Q_{13}, Q_{14}, \ldots$ correspond to the waveshape data $Q_1, Q_2, Q_3, Q_4, \ldots$, respectively.

On the other hand, in the second storage and readout line 50B, the timing pattern memory 22B reads out the timing pattern corresponding to the selected type of rhythm at a set quick tempo, whereby delivering out successive timing pulses $TPTN_2$. In accompaniment with such a timing pulse generation, start address data corresponding to the selected type of rhythm among those start address data of the storage section corresponding to the tempo range section II is read out successively. As a result, waveshape data $R_1, R_2, \ldots$ corresponding to the selected type of rhythm among those waveshape data of the storage section corresponding to the tempo range section II are read out successively at a constant speed for each percussion tone at a read-out start timing synchronous with the generation timing of the timing pulse $TPTN_2$ In this case, a quick tempo has been set, and therefore, the address advancement as viewed at the output side of the adder circuit 28B is such that addresses are skipped at portions such as $F_{21}$, and those waveshape data corresponding to the skipped addresses are not read out.

The waveshape data read out from the waveshape data memory 36B is supplied, as a waveshape data $OUT_2$, to the adder circuit 52 via the data adjustment circuit 38B. In (b) of FIG. 7, the waveshape data $OUT_2$ is shown in the form of an analog signal for the sake of convenience, and it should be noted that percussion tone signals $R_{11}, R_{12}, \ldots$ correspond to the waveshape data $R_1, R_2, \ldots$, respectively.

The waveshape data $OUT_1$ and $OUT_2$ are added together by the adder circuit 52, and the result is supplied to the D/A converter circuit 40. Accordingly, there is outputted, from the D/A converter circuit 40, a percussion tone signal OUT in the form of a mixture of the short enveloped percussion tone signal corresponding to the waveshape data $OUT_1$ and the long-enveloped percussion tone signal corresponding to the waveshape data $OUT_2$ as shown in (*c*) of FIG. 7. In response thereto, an automatic rhythm tone is sounded out from the loudspeaker 44.

Third Embodiment

Figure 8A:
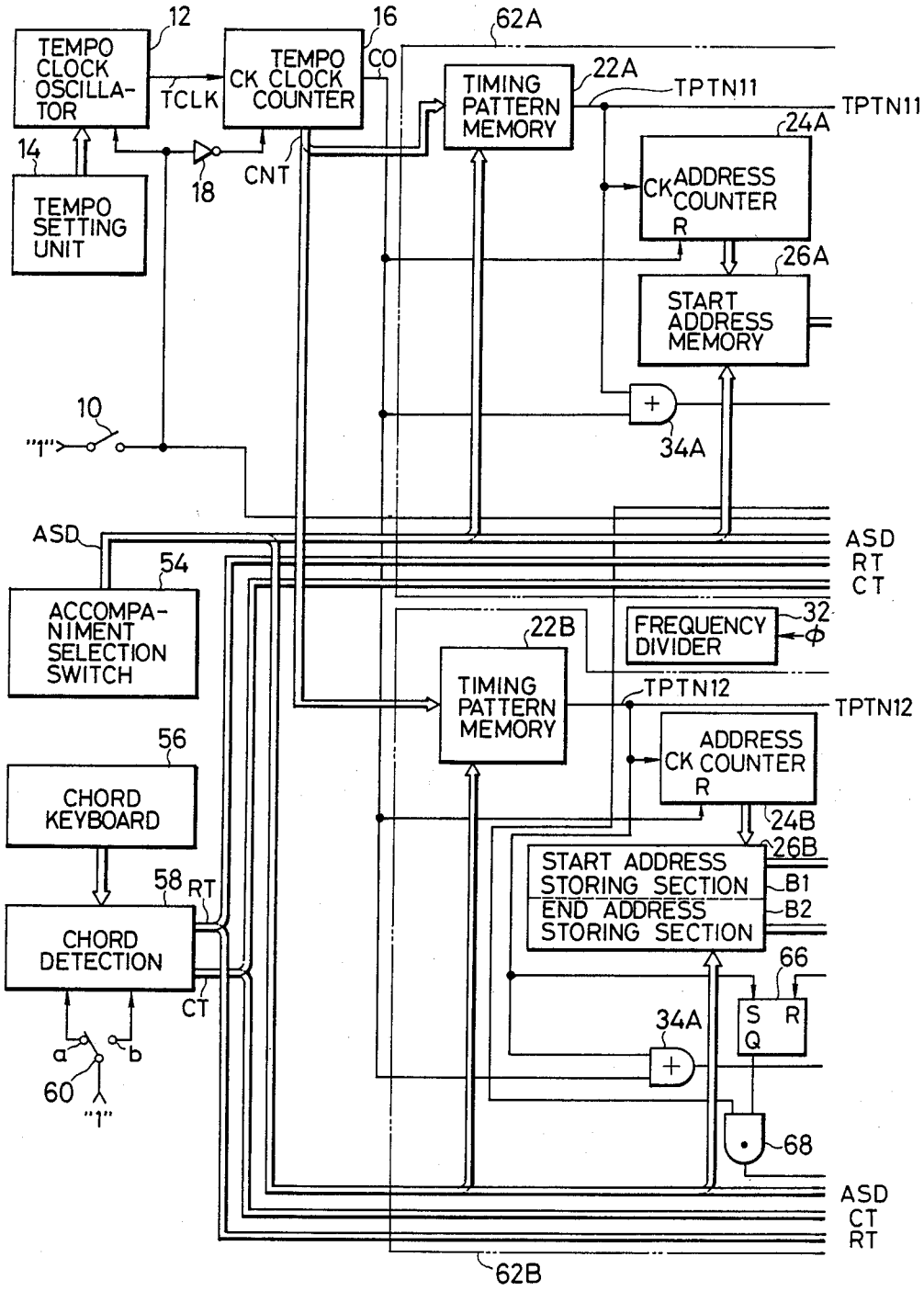
FIGS. 8A and 8B in combination are a block diagram showing an automatic accompaniment tone producing apparatus representing a third embodiment of the present invention.
Figure 8B:
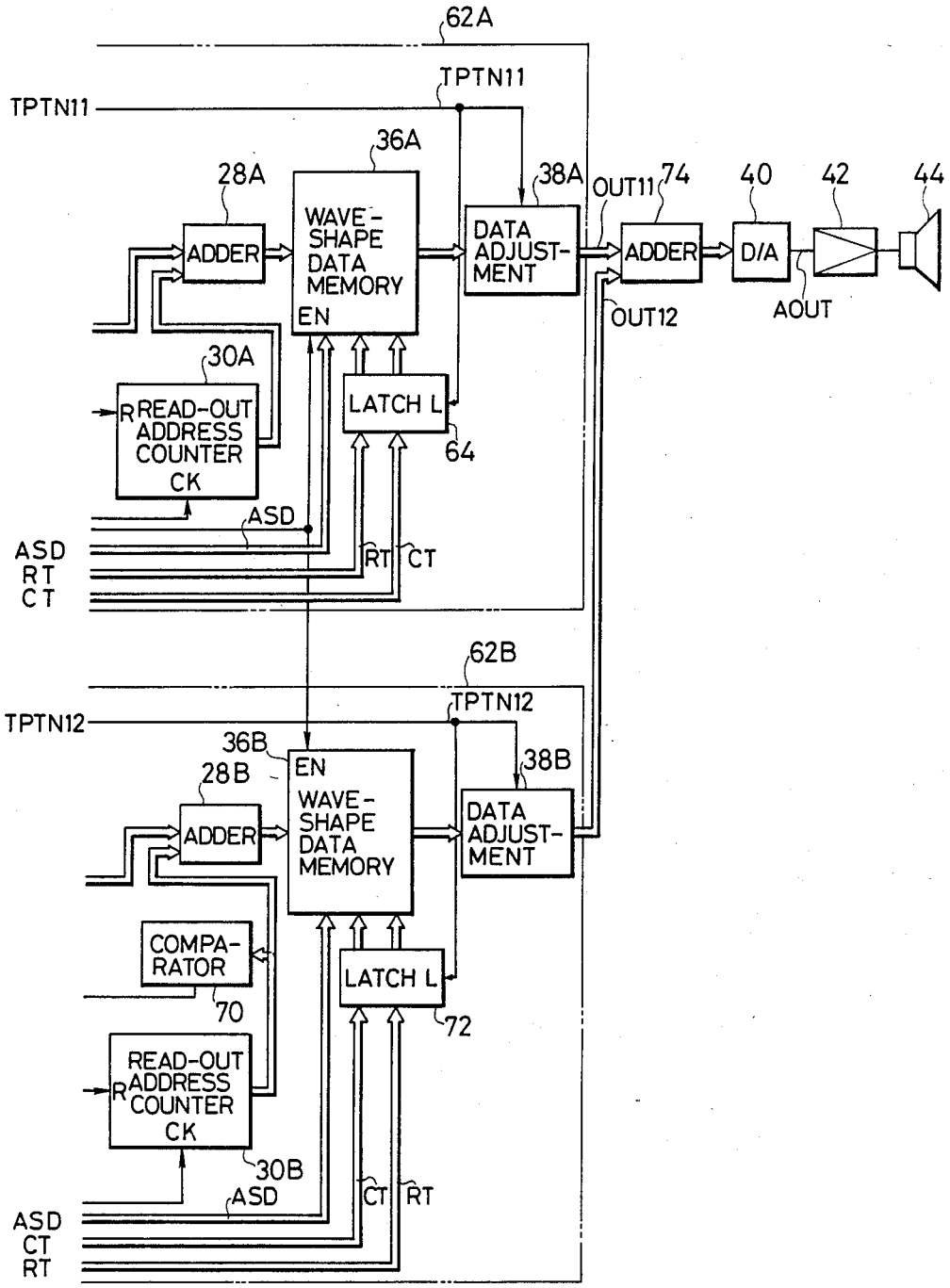

FIGS. 8A and 8B show in combination an automatic accompaniment tone producing apparatus according to the third embodiment of the present invention. Parts similar to those in FIGS. 1A and 1B are given like reference numerals, and their detailed description is omitted.

The apparatus shown in FIGS. 8A and 8B has two features. The first one is found in the arrangement that, in view of the fact that in case the present invention is applied, in a manner similar to that of FIGS. 1A and 1B, to automatic accompaniment of, for example, chords, basses and arpeggios, the blanked out portions of waveshape will be large for bass tones having a lengthy sustain time and that, accordingly, the tone qualities become degraded, and waveshape data of bass tones are stored and read out separately from chord and arpeggio tones.

Also, the second feature is to realize a reduction of the storage capacity of the memory by storing, in the memory, waveshape data from the rise up to the decay of each bass tone which is to be produced successively, and by suspending the reading-out of the waveshape data from the memory from the time the decay of a certain bass tone completes until the time immediately before the rise of the next bass tone. That is, in case of an automatic bass accompaniment, there could often occur a soundless state between a certain bass tone and the next bass tone. Accordingly, it is not advantageous for an effective use of the memory to store and read out the waveshape data corresponding to the soundless state. It is, therefore, the arrangement of this second feature to reproduce the soundless state by controlling the suspension of reading out the waveshape data supplied from the memory, in lieu of reading out from the memory the waveshape data corresponding to the soundless state.

Such a soundless state reproducing method as mentioned above may be adopted in the storage and read-out line 50B intended for long-enveloped percussion tones in the above-described embodiment of FIGS. 6A and 6B. This is because long-enveloped percussion tones have a small occurrence frequency just as bass tones.

An accompaniment selection switch circuit 54 contains accompaniment selection switches corresponding to those types of accompaniment such as waltz and rock. In accordance with an accompaniment selecting operation by means of these accompaniment selection switches, there is delivered out an accompaniment type designation data ASD indicative of the selected type of accompaniment.

A chord keyboard 56 contains a plurality of keys for use in the performance of chords, and is arranged so that the key depression data indicative of the depressed keys are supplied to a chord detection circuit 58.

The chord detection circuit 58 temporarily stores the key depression data supplied from the chord keyboard 56, and on the basis of the stored data, detects the root note and the type of the chord, to deliver out a root note designation data RT and a chord type designation data CT. In case a mode changeover switch 60 is set at a contact a, this circuit performs the detection of the chords in a fingered chord mode, and when the mode changeover switch 60 is set at a contact b, it detects the chord in a single finger mode.

In the detection of a chord in the fingered chord mode, there is designated a chord which is to be produced by a simultaneous depression of a plurality of keys corresponding to a desired chord in the chord keyboard 56. Arrangement is provided so that, when, for example, keys corresponding to the three notes C - E - G are depressed simultaneously, it should be noted that, there is delivered out, as the root note designation data RT, a data designating the root note "C", and as the chord type designation data CT, there is delivered out a data designating a chord type "major".

In the detection of a chord in the single finger mode, there arises a difference in the type of the designated chord between the instance wherein a single key is depressed on the chord keyboard 56 and the instance wherein a plurality of keys are depressed. That is, in case a single key is depressed, "major" is designated as the chord type, whereas as the root note, the tone of a note name corresponding to the depressed key is designated. Also, in case a plurality of keys are depressed, a root note is designated with the key of the lowest tone (or it may be the highest tone) among the plurality of the depressed keys, and a chord type is designated either by the number of the depressed other keys or by the kind of the key (either a natural key or a sharp key).

A first storage and read-out line 62A is intended for chords and arpeggio tones, and a second storage and read-out line 62B is for bass tones. In these first and second storage and read-out lines 62A and 62B, those blocks indicated by reference numerals added with either the letter "A" or "B" should be understood to possess substantially the same functions as those of the blocks in FIGS. 1A and 1B indicated by corresponding reference numerals alone.

In the first storage and read-out line 62A, a timing pattern memory 22A stores, for each type of accompaniment, a timing pattern indicating sequential chord-arpeggio tone producing timings. This memory is supplied, as a static address designation signal, an accompaniment type designation data ASD from the accompaniment switch circuit 54. The timing pattern memory 22A delivers out sequential timing pulses $TPTN_{11}$ corresponding to the selected type of accompaniment in accordance with the count output CNT delivered from the tempo clock counter 16.

A start address memory 26A stores, for each type of accompaniment, start address data for those chord-arpeggio tones which are produced successively. This memory is supplied, as a static address designation signal, with an accompaniment type designation data ASD coming from the accompaniment selection switch circuit 54. From the start address memory 26A is sequentially read out start address data corresponding to the selected type of accompaniment in accordance with the count output delivered from the address counter 24A.

A waveshape data memory 36A stores, for each type of accompaniment and for each type of chord, waveshape data of mixed tones for the chord, arpeggio and like tones to be produced sequentially. Here, each chord is identified in accordance with the root note and the type of chord. Therefore, even when the type of accompaniment is the same, there are stored, in the waveshape data memory 36A, different waveshape data for each different root note or chord type.

The waveshape data memory 36A is supplied, as a static address designation signal, with accompaniment type designation data ASD delivered from the accompaniment selection switch circuit 54.

A latch circuit 64 is intended to latch root note designation data RT and chord type designation data CT delivered from the chord detection circuit 58 in accordance with each timing pulse $TPTN_{11}$. The latched data is supplied, as a static address designation signal, to the waveshape data memory 36A. This latch circuit 64 is provided for the purpose of generating a next accompaniment tone in synchronism with the timing pulse $TPTN_{11}$ when keys are depressed for the next accompaniment tones in the midst of generation of a certain accompaniment tone.

In the second storage and read-out line 62B, a timing pattern memory 22B stores, for each type of accompaniment, a timing pattern indicative of sequential bass tone producing timings. This memory is supplied, as a static address designation signal, with an accompaniment type designation data ASD delivered from the accompaniment selection switch circuit 54. The timing pattern memory 22B delivers out sequential timing pulse $TPTN_{12}$ corresponding to the selected accompaniment type in accordance with the count output CNT delivered from the tempo counter 16.

The start address memory 26B has a start address storing section $B_1$ and an end address storing section $B_2$ The start address storing section $B_1$ stores, for each type of accompaniment, start address data for bass tones which are to be produced successively. The end address storing section $B_2$ stores for each type of accompaniment, end address data for bass tones which are to be produced successively. The start address memory 26B is supplied with an accompaniment type designation data ASD delivered from the accompaniment selection switch circuit 54. From the start address storing section $B_1$ are read out successively start address data corresponding to the selected type of accompaniment in accordance with the count output delivered from an address counter 24B. Also, from the end address storing section $B_2$, there are read out successively end address data corresponding to the selected type of accompaniment in accordance with the count output delivered from the address counter 24B.

An R-S flip-flop 66 is set in accordance with each timing pulse $TPTN_{12}$, and its output Q="1" renders an AND gate 68 conductive. When the AND gate 68 is rendered conductive, it supplies, as a clock input CK, the output pulses coming from the frequency divider 32 to a read-out address counter 30B. The count output of this read-out address counter 30B is supplied to an adder circuit 28B and also to a comparator circuit 70.

The comparator circuit 70 compares the end address data delivered from the end address storing section $B_2$ with the count output delivered from the read-out address counter 30B. Where there is a coincidence between the two, the comparator circuit delivers out a coincidence output EQ. This coincidence output EQ resets the flip-flop 66. In response to this resetting, the AND gate 68 is rendered non-conductive, and ceases the supply of pulses to the read-out address counter 30B. As a result, the counting operation of the read-out address counter 30B (i.e. advancement of address) ceases.

Such interruption of the counting operation continues till the flip-flop 66 is se±: in accordance with the next timing pulse TPTN.

A waveshape data memory 36B stores, for each type of accompaniment and for each type of chord, waveshape data for the bass tone which is to be produced successively. In this memory 36B are stored different waveshape data for each different root note or chord type even when the type of accompaniment remains to be the same. Here, the waveshape data corresponding to each bass tone does not contain a waveshape data indicative of the soundless state which develops in the interval till the next bass tone.

The waveshape data memory 36B is supplied, as a static address signal, with an accompaniment type designation data ASD delivered from the accompaniment selection switch circuit 54.

A latch circuit 72 is provided for the same purpose as for the above-described latch circuit 64. This circuit 72 is arranged so that it latches the root note designation data RT and the chord type designation data CT delivered from the chord detection circuit 58 in accordance with each timing pulse $TPTN_{12}$ to supply these data as static address designation signals to the waveshape data memory 36B.

An adder circuit 74 is intended to add up the waveshape data $OUT_{11}$ supplied, via the data adjustment circuit 38A, from the waveshape data memory 36A and the waveshape data $OUT_{12}$ supplied, via the data adjustment circuit 38B, from the waveshape data memory 36B. The addition output data from this adder circuit 74 is supplied to a D/A converter circuit 40, to be converted to an accompaniment tone signal $A_{OUT}$.

Accompaniment Tone Producing Operation

A desired reproduction tempo is set preliminarily by means of the tempo setting unit 14, and concurrently therewith a desired type (waltz, rock, . . . ) of accompaniment is selected by means of the accompaniment selection switch circuit 54. Also, the mode changeover switch 60 is set to either the contact a or b.

When a chord which is to be produced is selected by means of the chord keyboard 56, and the control switch 10 is turned on, waveshape data $OUT_{11}$ having relation to the selected chord are delivered out sequentially from the first storage and read-out line 62A in a manner similar to that described in connection with FIGS. 1A and 1B. That is, if the selected chord is, for example, a chord of C major, there are read out sequentially at the read-out start timings which are synchronous with the sequential timing pulse $TPTN_{11}$, and at respectively constant speeds for the respective tones, waveshape data indicative of sequential tones each of which is comprised of a mixed tone of the chord constituent C, E and G. In this instance, if the respective contents (stored data) of the timing pattern memory 22A, the start address memory 26A and the waveshape data memory 36A are provided for the performance of arpeggio, there are delivered out from the waveshape data memory 36A, at the read-out start timings which are synchronous with the sequential timing pulse $TPTN_{11}$ and at respectively constant speeds for the respective tones, waveshape data indicative of successive tones (in the form of a broken chord) comprised of C, E and G, respectively. In practice, however, there is an instance wherein the waveshape data which are indicative of both the sequential alignment of mixed tones (for a normal chord) and of solo tones (for a broken chord).

Accordingly, as the waveshape data $OUT_{11}$, if this is supplied to the D/A converter circuit 40, there is delivered out from a loudspeaker 44 such data that the normal chords and/or broken chords are generated in accordance with the selected accompaniment pattern (i.e. in synchronism with the timing pulse $TPTN_{11}$).

Next, if, on the chord keyboard 56, another chord is selected, i.e. if the chord is changed, the root note designation data RT and the chord type designation data CT corresponding to this selected chord are latched in the latch circuit 64 in accordance with the initial timing pulse $TPTN_{11}$ following said selection of another chord. As a result, there are delivered out from the first storage and read-out line 62A waveshape data $OUT_{11}$ having relation to said another chord in the same way as mentioned above. Thereafter, each time a new chord is selected on the chord keyboard 56, there is performed a waveshape data delivering-out operation similar to that described above.

Figure 9:
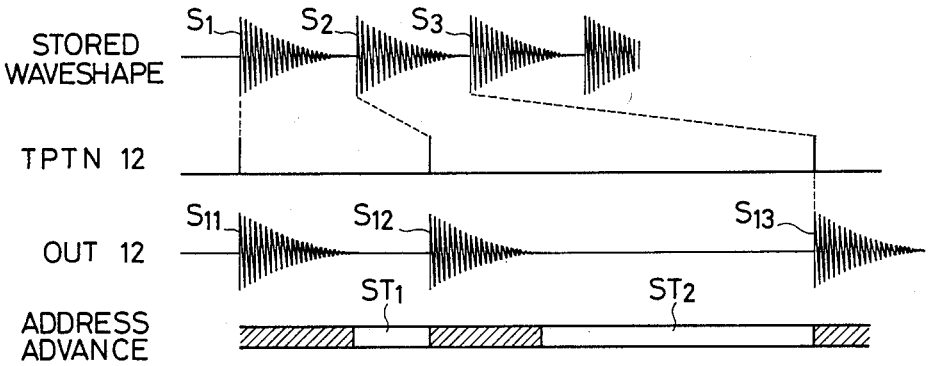
FIG. 9 is a time chart for explaining the bass tone producing operation of the apparatus of FIGS. 8A plus 8B.

On the other hand, from the second storage and read-out line 62B, there are delivered out waveshape data $OUT_{12}$ representing the sequential bass tones in such a manner as will be described below. In this instance, it should be assumed here that, in the waveshape data memory 36B, waveshape data $S_1$, $S_2$, $S_3$, . . . indicative of such stored waveshapes as shown in FIG. 9 are selected so as to be read out in accordance with the initial chord selection operation. In FIG. 9, the waveshape data $OUT_{12}$ and waveshape data $S_1$, $S_2$, $S_3$, . . . are shown in the form that they are converted to analog signals for the sake of convenience.

When the flip-flop 66 is set in accordance with the initial timing pulse $TPTN_{12}$, the read-out address counter 30B delivers out an address signal sequentially so as to indicate the address value which increases at a constant speed. Accordingly, a waveshape data $S_1$ corresponding to the initial bass tone is first read out at a constant speed from the waveshape data memory 36B. As a result, as the waveshape data $OUT_{12}$, a data representing the initial bass tone signal $S_{11}$ is delivered out.

Thereafter, when the value of the address signal delivered from the read-out address counter 30B coincides with the end address value indicated by the end address data delivered from the end address storage section $B_2$, the comparator circuit 70 generates a coincidence output EQ to reset the flip-flop 66. As a result, the read-out address counter 30B ceases its counting operation, and accordingly the address advancement as viewed at the output side of the adder circuit 28B ceases its operation for the length of time $ST_1$ till the generation of the next timing pulse $TPTN_{12}$ as shown in FIG. 9. By ceasing the reading-out of data from the waveshape data memory 36B during this read-out interruption time $ST_1$, there is reproduced the soundless state from the end of decay of the first bass tone signal $S_{11}$ up to the rise of the second bass tone signal $S_{12}$.

Next, when a second timing pulse $TPTN_{12}$ is generated, there is read out from the waveshape data memory 36B in response thereto a waveshape data $S_2$ corresponding to the second bass tone in the same way as described above. As a result, as the waveshape data $OUT_{12}$, a data corresponding to the second bass tone signal S12 is delivered out.

Thereafter, the read-out address counter 30B stops its counting operation in the same way as described above. The duration $TS_2$ of this ceased operation will continue until the generation of a third timing pulse $TPTN_{12}$.

Here, let us assume that another chord is selected on the chord keyboard 56 before the generation of this third timing pulse $TPTN_{12}$. Whereupon, a root note designation data RT and a chord type designation data CT corresponding to this selected chord are latched by a latch circuit 72 in accordance with the third timing pulse $TPTN_{12}$. As a result, in the waveshape data memory 36B, there are selected a bass tone waveshape data which are to be freshly read out in accordance with the latch data delivered from the latch circuit 72. Accordingly, there are read out from the waveshape data memory 36B freshly selected bass tone waveshape data as the waveshape data $OUT_{12}$ in place of the waveshape data $S_3$ in a manner similar to that described above. As a result, the third percussion tone signal $S_{13}$ becomes one corresponding to the freshly selected waveshape data and not corresponding to the waveshape data $S_3$.

Thereafter, for each selection of a new chord on the chord keyboard 56, similar bass tone waveshape data delivering-out operation to that described above is carried out.

The waveshape data $OUT_{11}$ and $OUT_{12}$ are subjected to adding in an adder circuit 74 and they are supplied to the D/A converter circuit 40. Accordingly, from the D/A converter circuit 40, there is delivered out an accompaniment tone signal AOUT which is a mixture of the chord/arpeggio tone signal corresponding to the waveshape data $OUT_{11}$ and the bass tone signal corresponding to the waveshape data $OUT_{12}$, and in response thereto, automatic accompaniment tones are sounded out from the loudspeaker 44.

It should be noted here that in the apparatus of FIGS. 8A and 8B, arrangement may be provided so that the waveshape data are recorded and reproduced separately for respective tempo ranges in the same way as in the case of the apparatus shown in FIGS. 6A and 6B. Also, there may be provided an arrangement that mixed tones of accompaniment tones and rhythm tones (percussion tones) are recorded and reproduced.

Fourth Embodiment

Figure 10A:
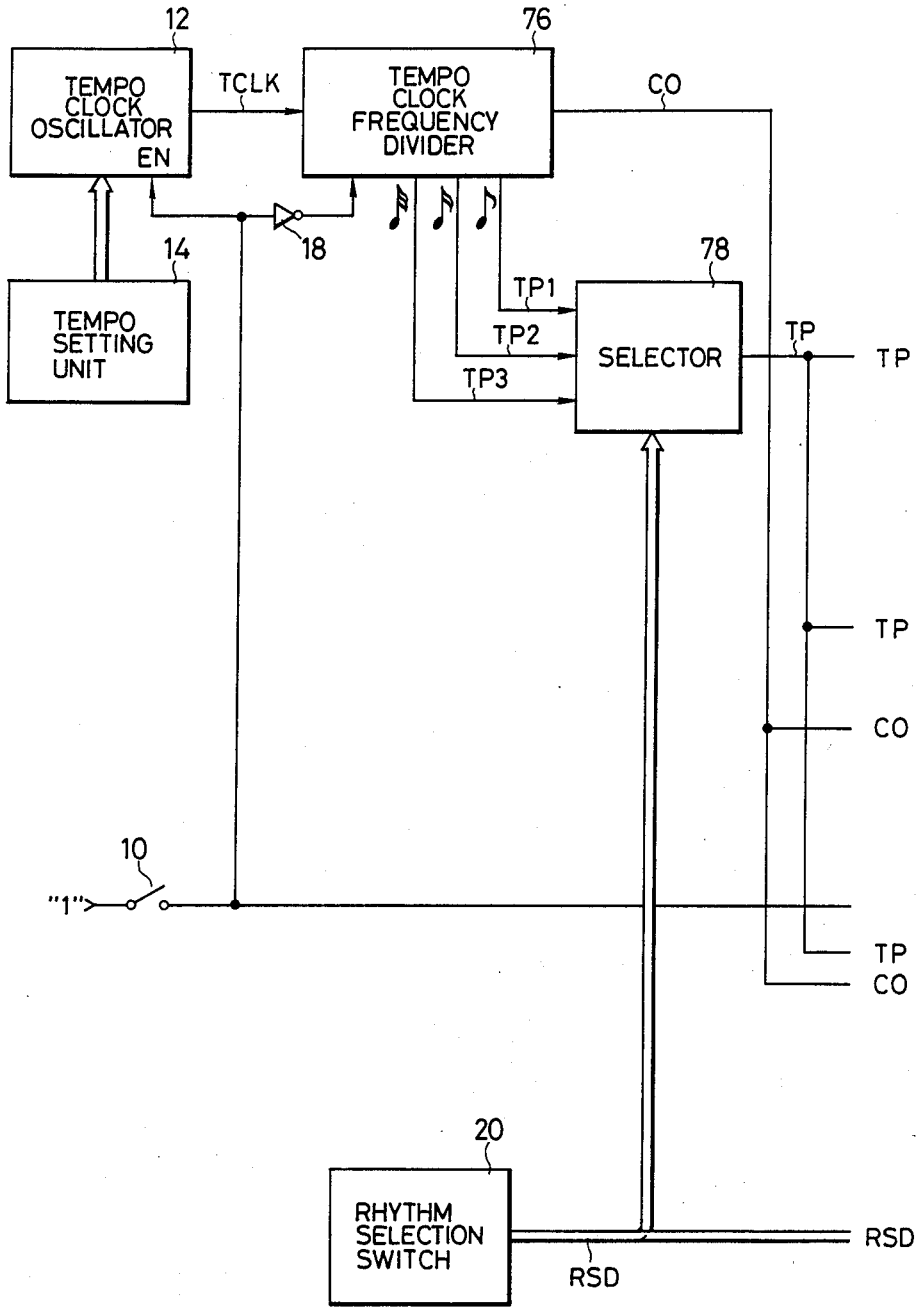
FIGS. 10A and 10B in combination are a block diagram showing an automatic rhythm tone producing apparatus representing a fourth embodiment of the present invention.
Figure 10B:
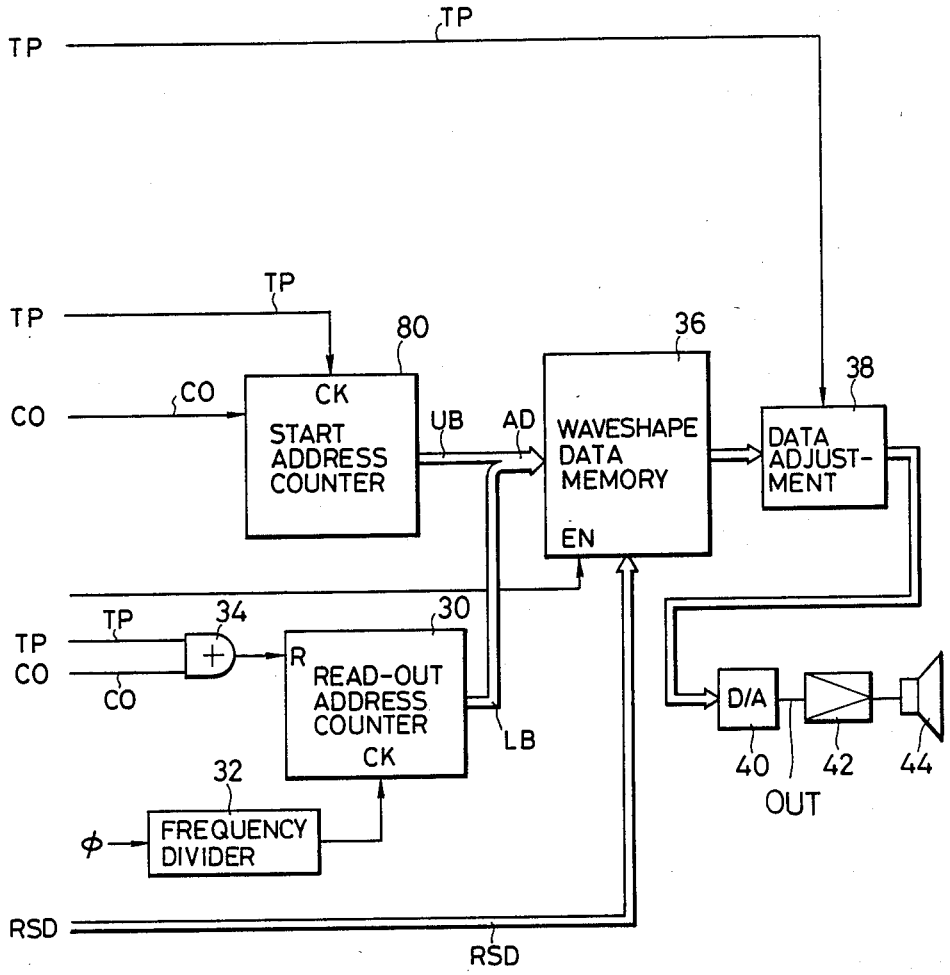

FIGS. 10A and 10B show in combination an automatic rhythm producing apparatus according to the fourth embodiment of the present invention. Like parts as those in FIGS. 1A and 1B are given like reference numerals, and their detailed explanation is omitted.

The feature of the apparatus of FIGS. 10A and 10B lies in the simplification of the arrangement of the waveshape data read-out circuit by using, for example, frequency divider and counter, in view of the instance wherein percussion tones are produced at a constant cycle depending on the type of rhythm pattern.

A tempo clock frequency divider 76 is comprised of a counter for dividing the frequency of the tempo clock pulse TCLK delivered from the tempo clock oscillator 12. It is arranged to generate timing pulses $TP_1 \sim TP_3$ of the first through the third groups, and also to generate a carry-out pulse CO when the control switch 10 is turned on and also every two measures. The timing pulse $TP_1$ of the first group is generated repeatedly at a time interval corresponding to the eighth note. The timing pulse $TP_2$ of the second group is generated repeatedly at a time interval corresponding to the sixteenth note. The timing pulse $TP_3$ of the third group is generated repeatedly at a time interval corresponding to the thirty-second note.

A selector circuit 78 selects, for delivery, a timing pulse of either one of the first to the third groups of timing pulse $TP_1$ to $TP_3$ in accordance with the rhythm type designation data delivered from the rhythm selection switch circuit 20.

The timing pulse TP which is delivered out from the selection circuit 78 acts in a manner similar to that described with respect to the timing pulse TPTN in connection with FIGS. 1A and 1B. This timing pulse TP is supplied to an OR gate 34, a start address counter 80 and a data adjustment circuit 38.

The start address counter 80, after being reset in accordance with the initial carry-out pulse CO which is generated when the control switch 10 is turned on, counts the repeated timing pulses TP and sequentially delivers out start address data. And, a resetting and counting operation similar to that described above is repeated each time the second and subsequent respective carry-out pulses CO are generated.

An address signal AD for reading out waveshape data from the waveshape data memory 36 is such that its upper bits US are comprised of the start address data supplied from the start address counter 80, and its lower bits LB are comprised of the constant speed read-out address signal coming from the read-out address counter 30. Accordingly, from the waveshape data memory 36 are read out, at a constant speed, waveshape data concerning the sequential percussion tones at read-out start timings synchronous with the sequential timing pulse TP, respectively, and for the respective percussion tones.

It should be noted here that, in the apparatus of FIGS. 10A and 10B, arrangement may be so made that waveshape data are recorded and reproduced separately for respective different tempo ranges and for respective different lengths of envelope in the same way as that for the apparatus of FIGS. 6A and 6B.

Fifth Embodiment

Figure 11A:
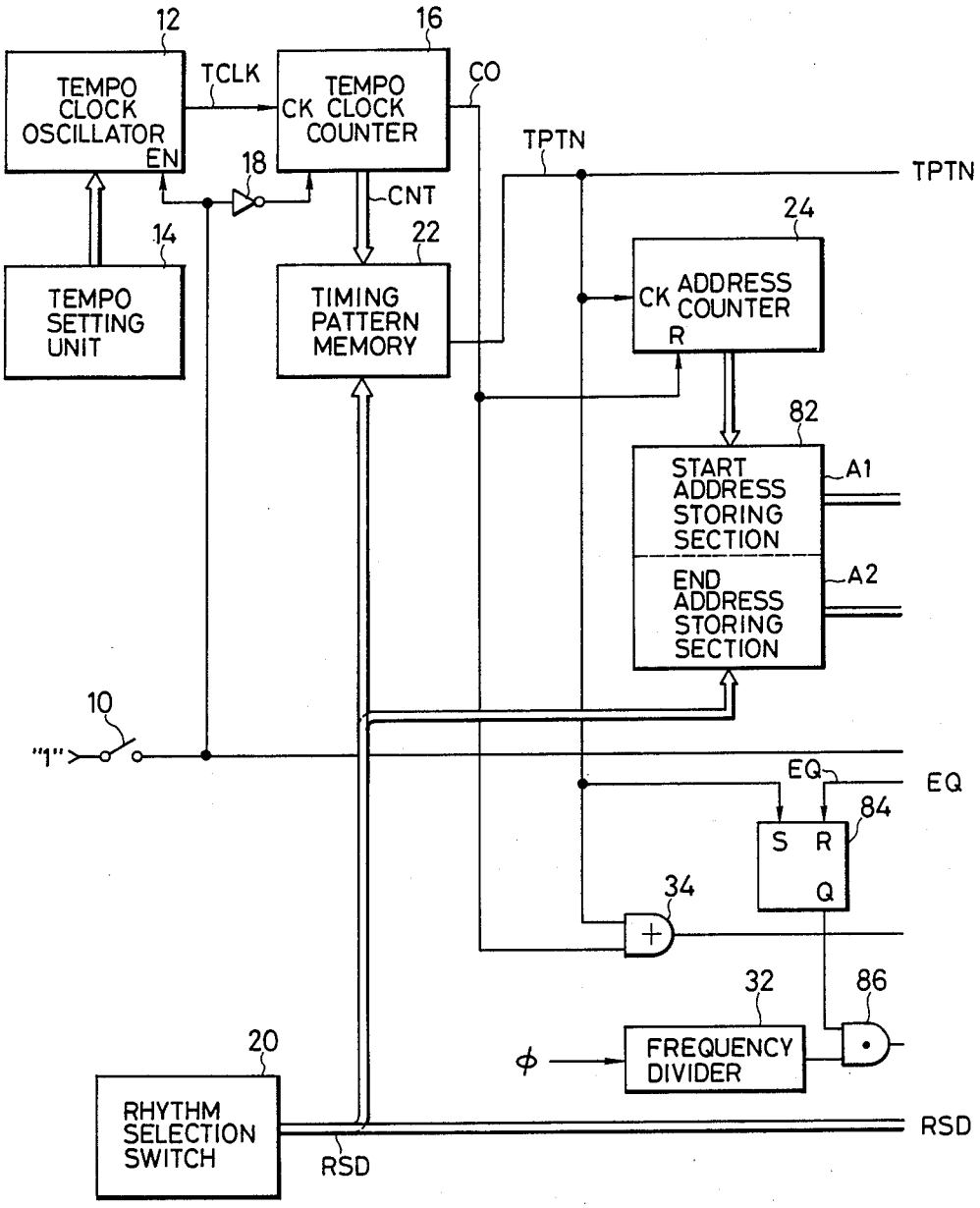
FIGS. 11A and 11B in combination are a block diagram showing the automatic rhythm tone producing apparatus representing a fifth embodiment of the present invention.
Figure 11B:
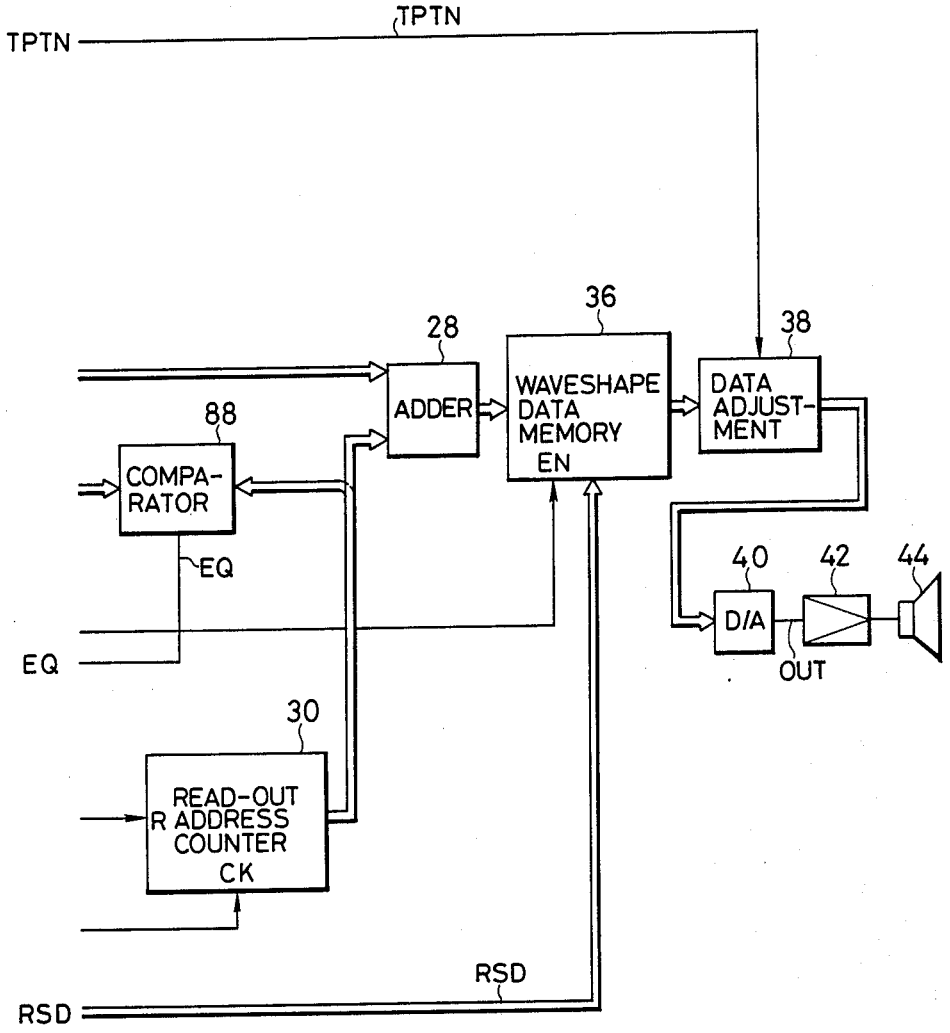

FIGS. 11A and 11B show in combination an automatic rhythm producing apparatus according to the fifth embodiment of the present invention. Like parts as in FIGS. 1A and 1B are given like reference numerals, and their detailed explanation is omitted.

The feature of the apparatus of FIGS. 11A and 11B lies in that slowing down of the tempo is feasible also, in view of the inconvenience in the apparatus of FIGS. 1A and 1B which is capable of only quickening the tempo.

A start address memory 82 has a start address storage section $A_1$ and an end address storage section $A_2$. The start address storage section $A_1$ stores, for each type of rhythm, start address data for the respective percussion tones which are to be produced sequentially. The end address storage section $A_2$ stores, for each type of rhythm, end address data for the respective percussion tones which are to be generated sequentially. The start address memory 82 is supplied with rhythm type designation data RSD delivered from a rhythm selection switch circuit 20. From the start address storage section $A_1$ read out sequentially start address data of the respective tones for the selected type of rhythm in accordance with the count output delivered from the address counter 24. Also, from the end address storage section $A_2$ are read out sequentially end address data of the same respective tones in accordance with the count output coming from the address counter 24.

An R-S flip-flop 84, and an AND gate 86 and a comparator circuit 88 are similar to the R-S flip-flop 66, the AND gate 68 and the comparator circuit 70, respectively, which are shown previously in FIGS. 8A and 8B, and they are intended to control the read-out interrupting operation of the read-out address counter 30.

Rhythm Tone Producing Operation

In the apparatus of FIGS. 11A and 11B, the rhythm tone producing operation in case the tempo is quickened is such that, without the flip-flop 84 being reset, the AND gate 86 is always kept conductive by the output Q="1" of this flip-flop 84, so that this operation is identical with that described in connection with FIGS. 1A and 1B.

Figure 12:
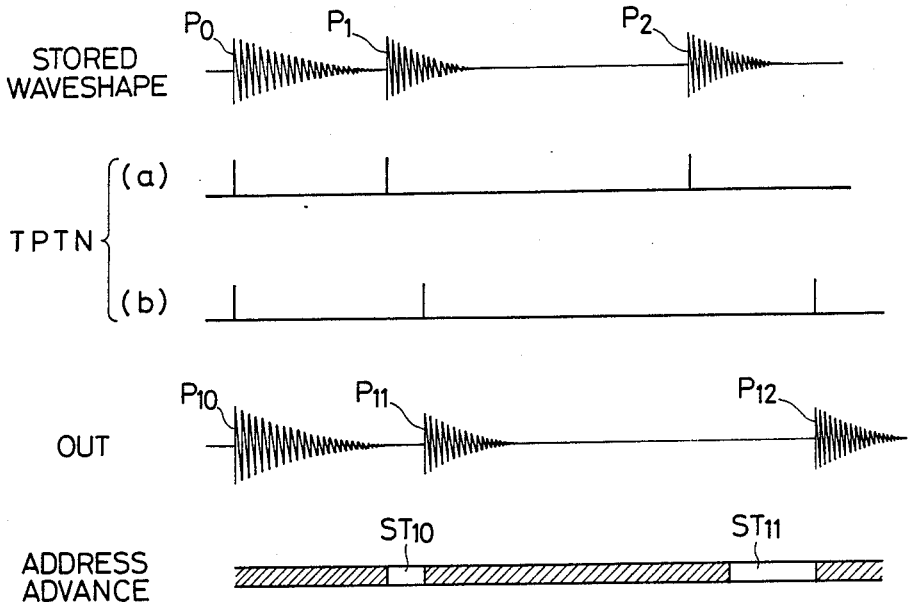
FIG. 12 is a time chart for explaining the rhythm tone producing operation of the apparatus of FIGS. 11A plus 11B.

The rhythm producing operation in case the tempo is slowed down will be described by referring to FIG. 12, as follows. In FIG. 12, the stored waveshapes in the waveshape memory 36 are shown in the form that the waveshape data P0, $P_1$, $P_2$, . . . representing the sequential percussion tones are converted to analog signals. Also, the sequential timing pulses TPTN are illustrated therein in two ways, (a) one of which is for the instance wherein a tempo is set as same as that of recording, and (b) the other is the instance that a tempo is set slower than that of recording. According to this arrangement, it will be noted that the pulse interval is wider in the case (b) where the tempo is set slower, as compared with the instance of (a).

When the flip-flop 84 is set in accordance with the initial timing pulse TPTN, the AND gate 86 is rendered conductive in accordance with the output Q="1" of this flip-flop, and the output pulse of the frequency divider 32 is supplied, via the AND gate 86, to the read-out address counter 30.

The read-out address counter 30, by counting, after being initially reset, the output pulses delivered from the AND gate 86, delivers out an address signal sequentially so as to indicate the address value which increases at a constant speed. Accordingly, from the waveshape data memory 36 is sequentially read out, at a constant speed, waveshape data $P_0$ corresponding to the first percussion tone. As a result, as the percussion tone signal OUT, there is generated first percussion tone signal $P_{11}$ corresponding to the waveshape data $P_0$.

Thereafter, when the value of the address signal coming from the read-out address counter 30 coincides with the end address value for the first tone indicated by the end address data delivered from the end address storage section A2, a comparator circuit 88 generates a coincidence output EQ to reset the flip-flop 84, and in accordance therewith, the AND gate 86 is rendered non-conductive. Accordingly, the read-out address counter 30 ceases its counting operation, and the advancement of address as viewed at the output side of the adder circuit 28 ceases for the period of time ST10 until the generation of a next timing pulse TPTN (b) as shown in FIG. 12.

Next, when a second timing pulse TPTN (b) is generated, the flip-flop 84 is set in accordance therewith. Accordingly, in a manner similar to that described above, there are read out from the waveshape data memory 36 waveshape data $P_1$ corresponding to the second percussion tone, and as the percussion tone signal OUT, there is generated a second percussion tone signal $P_{11}$. And, in a manner similar to that described above, the read-out address counter 30 ceases its counting operation for the length of time $ST_{11}$ upon coincidence with the end address value for the second tone.

Thereafter, the waveshape data read-out operation same as that described above is repeated, and a third and subsequent percussion tone signals such as $P_{12}$ are generated in succession at a slow tempo.

Sixth Embodiment

Figure 13A:
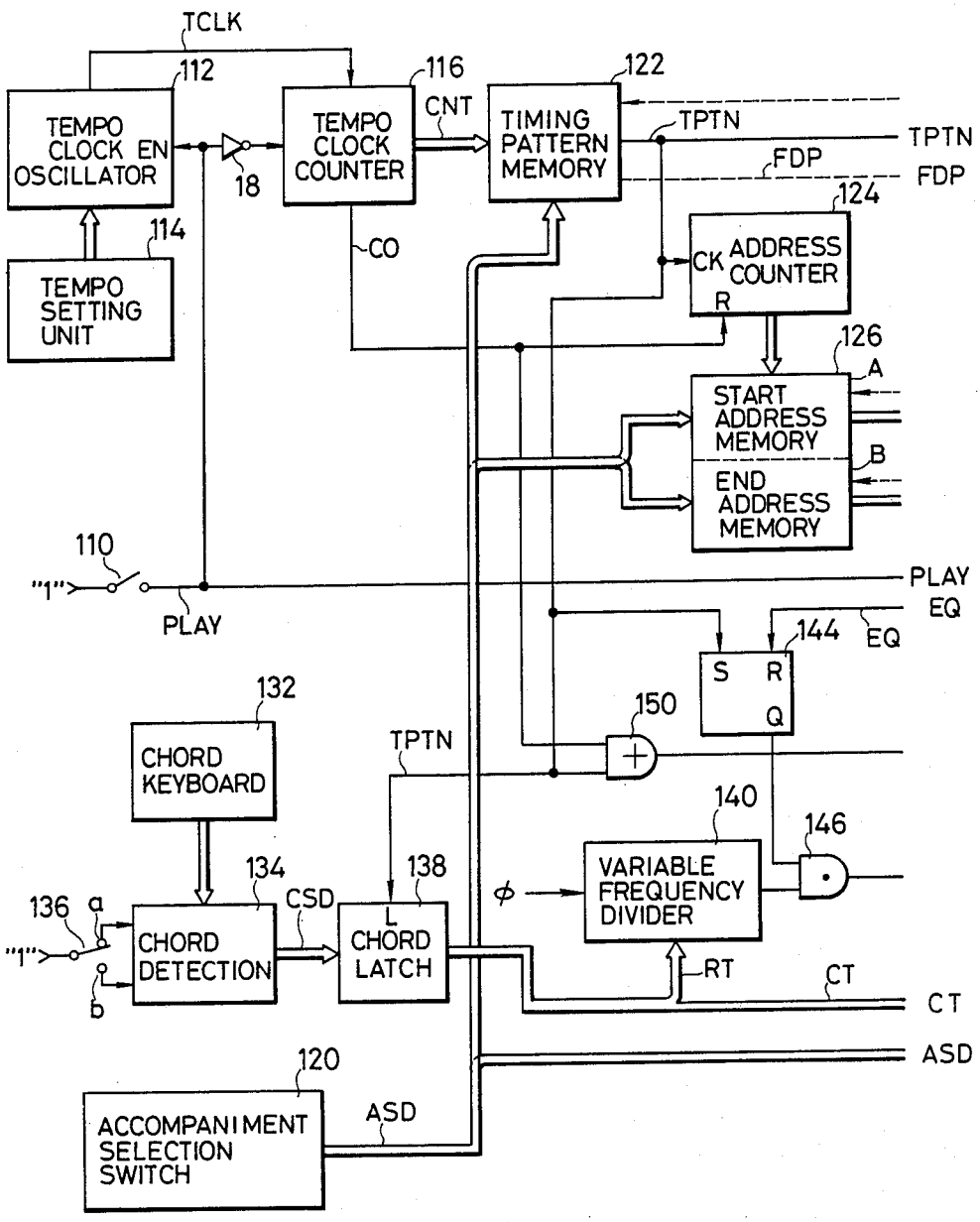
FIGS. 13A and 13B in combination are a block diagram showing a tone producing apparatus arranged as an automatic accompaniment apparatus representing a sixth embodiment of the present invention.
Figure 13B:
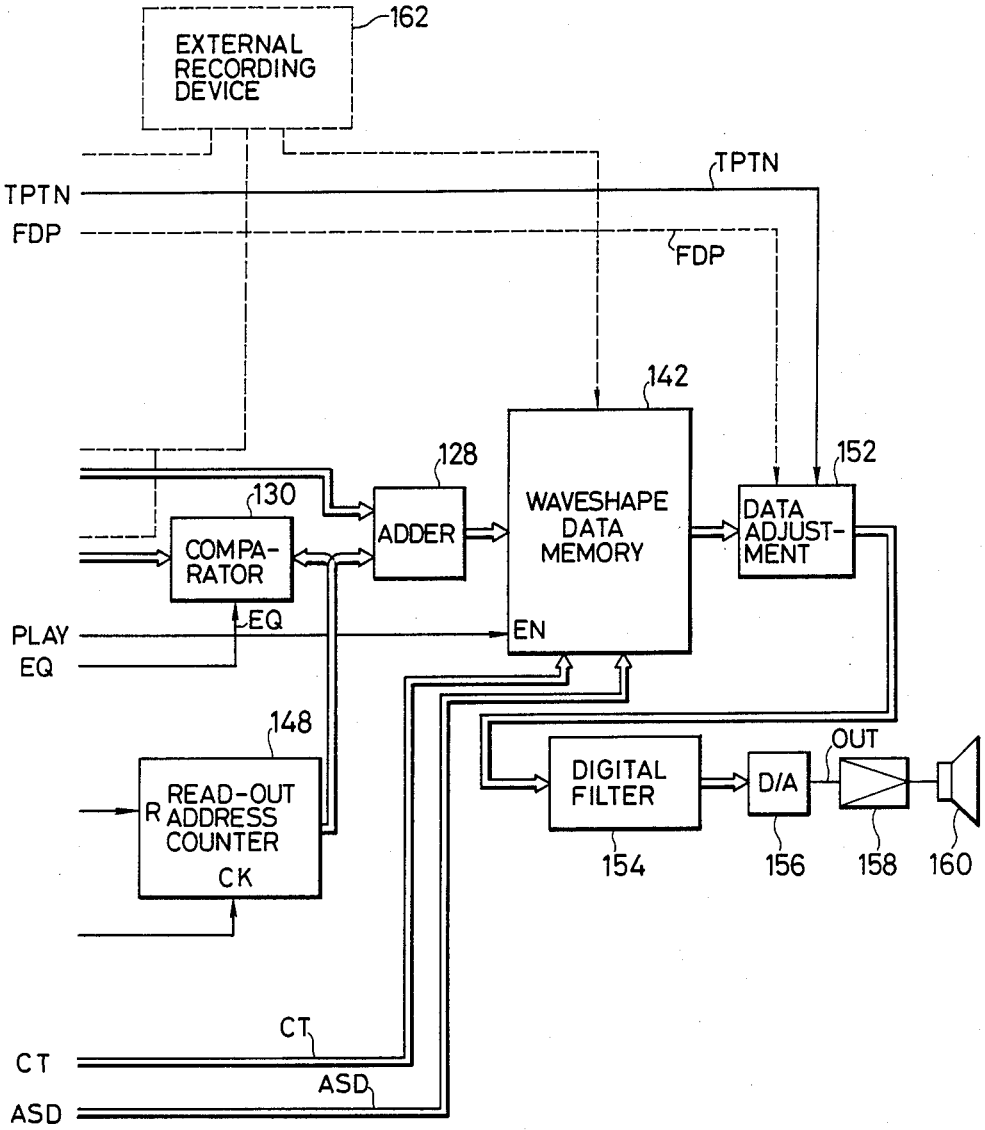

FIGS. 13A and 13B show in combination a tone producing apparatus arranged as an automatic accompaniment apparatus according to the sixth embodiment of the present invention.

A start-stop control switch 110 is provided for on-off operation at the time of starting and stopping an accompaniment, respectively, and it is connected to a "1" signal supply. When the control switch 110 is turned on, the play mode signal PLAY becomes "1".

Figure 14:
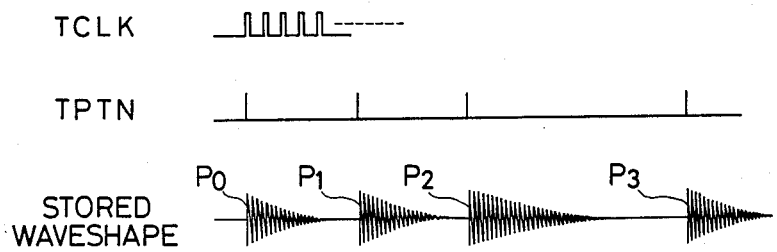
FIG. 14 is a time chart for explaining the accompaniment tone producing operation of the apparatus of FIGS. 13A plus 13B.

A tempo clock oscillator 112 is rendered to the enabled state when the play mode signal PLAY becomes "1", and generates a tempo clock pulse TCLK as shown in FIG. 14.

A tempo setting unit 114 contains a control knob which is manipulated by, for example, fingers of the user. This unit 114 is arranged so that it supplies to the tempo clock oscillator 112 a tempo control data which indicates a set tempo. The frequency of the tempo clock pulse TCLK which is generated from the tempo clock oscillator 112 is controlled in accordance with a tempo control data delivered from the tempo setting unit 114, and is determined in accordance with the set tempo.

A tempo clock counter 116 is comprised of a flip-flop having such a number of stages as corresponds to the length of, for example, one measure, and is arranged so that it counts the tempo clock pulse TCLK and generates a count output CNT and a carry-out pulse CO. This tempo clock counter 116 is set in such way that, before the control switch 110 is turned on, the whole bits of the count output CNT become "1" in accordance with the output signal "1" of an inverter 118 which receives a play mode signal PLAY="1". And, when the play mode signal PLAY becomes "1" in accordance with the turn-on operation of the control switch 110, the tempo counter 116 generates an initial carry-out pulse CO as the whole bits of the count output CNT assume the "0" state in accordance with the initial tempo clock pulse TCLK coming from the tempo clock oscillator 112.

Thereafter, the tempo clock counter 116 sequentially counts the second and subsequent tempo clock pulse TCLK, and sequentially increases its count value.

When the tempo counter 116 counts the tempo clock pulses TCLK for one measure, the whole bits of the count output CNT become "1". And, the tempo counter 116 generates a second carry-out pulse CO as the whole bits of the count output CNT assume the state of "0" in accordance with the initial tempo clock pulse TCLK of the second measure. Thereafter, sequential counting operation similar to that described above is repeated, and from the tempo clock counter 116, there is repetitively generated a sequential count output CNT and a carry-out pulse CO is generated after lapse of every one measure.

An accompaniment selection switch circuit 120 contains accompaniment selection switches corresponding to such types of accompaniment as waltz and rock, and is arranged so that, in accordance with the accompaniment selection operation by means of these accompaniment selection switches, it delivers out an accompaniment type designation data ASD indicated by the selected type of accompaniment.

A timing pattern memory 122 stores, for each type of accompaniment as mentioned above, a timing pattern indicative of sequential accompaniment generation timings. To this memory 122 is supplied, as a static address designation signal, an accompaniment type designation data ASD coming from the accompaniment selection switch circuit 120, and concurrently the memory 122 is supplied, as a dynamic address designation signal, with the count output CNT coming from the tempo clock counter 116.

When a specific type of accompaniment is designated by the accompaniment type designation data ASD, a timing pattern corresponding to the designated type of accompaniment is read out repetitively in accordance with the count output CNT. Accordingly, a sequential timing pulse TPTN is delivered out from the timing pattern memory 122 in accordance with the timing pattern corresponding to the specified type of accompaniment, as shown in FIG. 14.

An address counter 124 receives the timing pulse TPTN as a clock input CK, and also receives the carry-out pulse CO as its reset input R. It is arranged so that, when it is supplied simultaneously with both the clock input CK and the reset input R, the reset input R acts preferentially. The address counter 124 is set so that before the control switch 110 is turned on, the whole bits of the count output CNT of the tempo clock counter 116 become "1" in accordance with the output signal "1" of the inverter 118 which receives the play mode signal PLAY="0". And, as stated above, when the control switch 110 is turned on, there is generated an initial carry-out pulse CO from the tempo clock counter 116. The address counter 124, after being reset in accordance with this initial carry-out pulse CO, sequentially counts the timing pulse TPTN, and supplies its count output as a dynamic address designation signal to an address storing unit 126.

This address storing unit 126 has a start address memory A and an end address memory B. In the start address memory A is stored, for each type of such accompaniment as mentioned above, start address data indicative of read-out start addresses for the accompaniment tones which are to be produced sequentially. In the end address memory B is stored, for each type of such accompaniment as mentioned above, end address data indicative of read-out end addresses for accompaniment tones which are to be produced sequentially. To the start address memory A and to the end address memory B is supplied, as a static address designation signal, an accompaniment type designation data ASD coming from the accompaniment selection switch circuit 120.

When a specific type of accompaniment is designated by the accompaniment type designation data ASD, there are read out sequentially from the start address memory A start address data of the respective tones for the designation type of accompaniment in accordance with the count output of the address counter 124, to be supplied to an adder 128. On the other hand, from the end address memory B are sequentially read out end address data of the same respective tones in accordance with the count output of the address counter 124, and they are supplied to a comparator 130.

A chord keyboard 132 contains a plurality of keys for the performance of chords, and is arranged to supply key depression data indicated by the depressed keys to a chord detection circuit 134.

The chord detection circuit 134 temporarily stores the key depression data supplied from the chord keyboard 132, and detects the root note of and the type of the chord based on the stored data. This circuit 134 is arranged so that it delivers out a chord designation data CSD which contains both the root note designation data and the chord type designation data. The chord detection circuit 134 performs the detection of chords in two ways, and either one of these two chord detection operations is performed by setting a mode change-over switch 136 to either one of its contacts a and b. That is, in case the switch 136 is set to the contact a, there is performed an operation of detecting a chord of the fingered chord mode, whereas in case the switch 136 is set to the contact b, a single finger mode chord detection operation is performed.

In the chord detection of the fingered chord mode, the chord which is to be played is designated by simultaneously depressing a plurality of keys corresponding to a desired chord on the chord keyboard 132. In case keys corresponding to the three notes, for example C - E - G, are depressed, a root note designation data for designating the root note "C" is delivered out, whereas as the chord type designation data, a data designating the chord type "major" is delivered out.

In the single finger mode chord detection, there arises a difference in the type of chord which is to be designated depending on the instance whether a single key is depressed on the chord keyboard 132 or a plurality of keys are depressed thereon. More specifically, when a single key is depressed, "major" is designated as the chord type, whereas as the root note, the tone of a note corresponding to the depressed key is designated. Also, in case a plurality of keys are depressed, the root note is designated by the key of the lowest tone pitch (or may be highest tone pitch) among the depressed plural keys, and the chord type is designated by either the number or type (natural or sharp) of the other depressed keys.

A chord latch circuit 138 is intended to latch a chord type designation data CSD coming from the chord detection circuit 134 in accordance with each timing pulse TPTN. Among the latched data, the root note designation data RT is supplied to a variable frequency divider 140, while the chord type designation data CT is supplied to a waveshape data memory 142. The chord latch circuit 138 is provided to produce next accompaniment tones in synchronism with the timing pulse TPTN when a key is depressed for the next accompaniment tone in the midst of production of a certain accompaniment tone.

The variable frequency divider 140 variably divides the frequency of the system clock signal $\phi$ in accordance with the root note designation data RT, and the respective dividing factors are so determined that the frequencies of the frequency-divided output pulses corresponding to the root notes C, C#, . . . , B, respectively, should be such that the frequency ratio between adjacent two notes be $2^{1/12}$.

An R-S flip-flop 144 is arranged to be set in accordance with each timing pulse TPTN, and its output Q="1" renders an AND gate 146 conductive. When the AND gate 146 becomes conductive, it supplies, as a clock input CK, the frequency-divided output pulse coming from the variable frequency divider 140 to a read-out address counter 148.

The read-out address counter 148 counts the frequency-divided output pulses supplied thereto from the variable frequency divider 140 via the AND gate 146, and sequentially generates address signals so as to indicate the address values which vary at a speed determined by the frequency of the abovesaid frequency-divided output pulse. This counter 148 is arranged so that it is reset in accordance with either the carry-out pulse CO or the timing pulse TPTN coming from an OR gate 150. When the control switch 110 is turned on, the OR gate 150 generates an initial output signal "1" in accordance with the initial carry-out pulse CO and with the initial timing pulse TPTN. The read-out address counter 148, after being reset in accordance with the initial output signal "1" supplied from the OR gate 150, sequentially counts the frequency-divided pulses coming from the AND gate 146, and is reset in accordance with the second timing pulse TPTN, and thereafter it repeats similar count-and-reset operations. And, after lapse of one measure, the read-out address counter 148 is reset by the second carry-out pulse CO. Thereafter, such count-and-reset operation as mentioned above is repeated in a similar way. The address signal which is delivered out from the read-out address counter 148 is supplied, on the one hand, to the adder 128, and it is supplied, on the other hand, to the comparator 130.

The comparator 130 compares the end address data supplied from the end address memory B with the address signal coming from the read-out address counter 148, and when these two coincide with each other, it delivers out a coincidence output EQ. This coincidence output EQ resets the flip-flop 144, and in accordance with this resetting, the AND gate 146 becomes non-conductive, to thereby cease the supply of frequency-divided pulses to the read-out address counter 148. As a result, the counting operation (i.e. address advancement) of the read-out address counter 148 ceases.

Such a halt of the counting operation continues until the flip-flop 144 is set in accordance with the next timing pulse TPTN.

The adder 128 adds up the start address data coming from the start address memory A with the address signal supplied from the read-out address counter 148. Its addition output is supplied to the waveshape data memory 142 as a waveshape data read-out address signal.

The waveshape data memory 142 stores, for each type of such accompaniment as mentioned above and for each type of chord, wave data representing the waveshapes of the sequentially produced accompaniment tones. As the stored waveshape data, there are provided digital waveshape data for one measure which are comprised of digital words indicative of sample values of waveshape for each accompaniment tone. Such digital waveshape data are obtained by recording an actual accompaniment performance of the instrument player, and by sampling the recorded signals at a certain sampling rate, and by subjecting each sample value to analog/digital (A/D) conversion.

The waveshape data memory 142 is supplied, as a static address designation signal, with an accompaniment type designation data ASD coming from the accompaniment selection switch circuit 120, and is arranged so that waveshape data which are to be read out are selected in accordance with the accompaniment type designation data ASD and the above-said chord type designation data CT.

The waveshape data memory 142 is rendered to the enabled state when the play mode signal PLAY becomes "1" in accordance with the turning-on operation of the control switch 110, and in this state, selected waveshape data are read out in accordance with the address signal delivered from the adder 128. The read-out speed in this instance is determined in accordance with the root note of the chord designated on the chord keyboard 132.

The waveshape data of the respective accompaniment tones which are read out from the waveshape data memory 142 are supplied to a data adjustment circuit 152. This data adjustment circuit 152 is intended to adjust the waveshape sample values to smooth the waveshape connecting configuration of the sequential accompaniment tones in the manner as was described before in connection with FIG. 4 or FIG. 5, and its detailed explanation is omitted here.

The waveshape data for the sequential accompaniment tones which are delivered out from the data adjustment circuit 152 are supplied to a digital filter 154. As stated previously, the read-out speed of the waveshape data varies for each different root note which is designated. Therefore, in this invention, there is performed formation of the musical tones, basically, by floating format manner. Therefore, it is the digital filter 154 that is provided for imparting the tendency of the fixed formant type processing. The waveshape data are subjected to a slight adjustment of waveshape by being passed through this digital filter 154.

The waveshape data for the sequential accompaniment tones which are delivered out from the digital filter 154 are supplied to a digital/analog (D/A) converter circuit 156 to be converted to analog accompaniment tone signals OUT. And, the accompaniment tone signals OUT which are sequentially delivered out from the D/A converter circuit 156 are supplied to a loudspeaker 160 via an output amplifier 158 to be converted to audible accompaniment sounds. Accordingly, automatic accompaniment tones are sounded out from the loudspeaker 160.

Accompaniment Tone Producing Operation

Here, the accompaniment tone producing operation will be described by referring to FIG. 14. The stored waveshapes in FIG. 14 are a group (train) of waveshape data selected in accordance with an accompaniment type designation data ASD and a chord type designation data CT from among the waveshape data stored in the waveshape data memory 142, and are illustrated there in the form of analog signals for the sake of convenience.

The waveshape data $P_0$, $P_1$, $P_2$, . . . . represent the waveshapes of the accompaniment tones which are to be produced successively, and the waveshape data corresponding to the respective accompaniment tones are each comprised of numerous digital words indicative of continuous waveshape sample values starting at the rise of such an accompaniment tone up to immediately before the rise of the next accompaniment tone. Such digital waveshape data are obtained by digital recording of an actual performance of accompaniment including, for example, chords, arpeggio tones and bass tones. In order to perform a digital recording, the root note is set to, for example, G note, and accompaniment is performed by variously changing the types of chords for each type of accompaniment, and waveshape data corresponding to a plurality of chord types are stored in the waveshape data memory 142 for each type of accompaniment.

The waveshape of the accompaniment tones indicated by the waveshape data $P_0$, $P_1$, $P_2$, . . . could be the waveshapes of solo tones or the waveshapes of mixed tones. In case of, for example, a chord, there is produced a mixed tone of three tones constituting the chord. There may be a case where the waveshape data $P_0$ and $P_1$ both indicate the waveshapes of chords, while the waveshape data $P_2$ indicates the waveshape of a mixed tone of a chord and a bass. Also, in case of arpeggio, the first, second and third solo tones which constitute a chord are produced successively. Further, the waveshape data $P_0$ and $P_1$ may be those which indicate the waveshape of the first and second solo tones, respectively, while the waveshape data $P_2$ may be one which indicates the waveshape of a mixed tone of the third solo tone and a bass tone.

Now, let us assume here that a tempo is set as same as that of recording by the variable tempo setting unit 114. Also, let us assume that, along with setting a specific type of accompaniment by means of the accompaniment selection switch circuit 120, a specific chord whose root note is G is designated by means of the chord keyboard 132, and that, thereby a train of waveshape data indicative of the stored waveshapes of FIG. 14 is selected for being read out.

When the control switch 110 is turned on, the tempo clock oscillator 112 generates tempo clock pulse TCLK at a frequency corresponding to the set tempo as shown in FIG. 14. As stated previously, the tempo clock counter 116 generates an initial carry-out pulse CO in accordance with the initial tempo clock pulse. Also, simultaneously therewith, all bits of the count output CNT becomes "0". In response thereto, the timing pattern memory 122 starts the generation of a timing pulse TPTN in accordance with the timing pattern corresponding to the selected type of accompaniment as shown in FIG. 14.

The initial carry-out pulse CO and the initial timing pulse TPTN are inputted to the address counter 124 almost simultaneously. However, as stated previously, resetting has priority, and the address counter 124 is reset in accordance with the initial carry-out pulse CO, and the whole bits of its count output become "0". As a result, a start address data indicative of the read-out start address of the waveshape data $P_0$ corresponding to the first accompaniment tone is read out from the start address memory A.

Also, the initial carry-out pulse CO and the initial timing pulse TPTN are inputted almost simultaneously to an OR gate 150. In response thereto, the OR gate 150 generates its initial output signal "1". This initial output signal "1" resets the read-out address counter 148, so that the count output of this counter 148 will have all bits thereof rendered "0".

The initial timing pulse TPTN sets the flip-flop 144, and in response thereto, the AND gate 146 is rendered conductive. Also, the chord latch circuit 138 latches, in accordance with the initial timing pulse TPTN, the chord type designation data CSD coming from the chord selection circuit 134. The data which are latched at such a time contain a root note designation data RT which indicates the root note G and a chord type designation data CT which is indicative of a certain type of chord.

The variable frequency divider 140 generates a frequency-divided output pulse at a frequency corresponding to the root note G in accordance with the root note designation data RT, and delivers it to the read-out address counter 148 via the AND gate 146. The read-out address counter 148 sequentially counts the frequency-divided output pulses, and sequentially delivers an address signal. As a result, the adder 128 sequentially generates an address signal so as to indicate an address value which increases at a speed corresponding to the root note G starting at the read-out start address. In response thereto, from the waveshape data memory 142 are read out waveshape data $P_0$ corresponding to the first accompaniment tone.

The waveshape data read out from the waveshape data memory 142 are supplied to the D/A converter circuit 156 via the data adjustment circuit 152 and a digital filter 154, and from this D/A converter circuit 156 is generated a first accompaniment tone signal OUT. In response to this accompaniment tone signal OUT, there is sounded out a first accompaniment tone from the loudspeaker 160. In this case, if the first accompaniment tone is a chord, there is produced a chord having a root note G.

Next, when a second timing pulse TPTN is generated from the timing pattern memory 122, the count value of the address counter 124 becomes 1 (one). In response thereto, a start address data for the waveshape data $P_1$ is read out from the start address memory A. Also, the read-out address counter 148, after being reset in accordance with the second timing pulse TPTN, sequentially counts the frequency-divided pulses and generates an address signal sequentially in a manner similar to that described in connection with the above operation.

Accordingly, from the waveshape data memory 142 are sequentially read out waveshape data $P_1$ for the second accompaniment tone at a speed corresponding to the frequency of the root note G. In response thereto, the second accompaniment tone is sounded out from the loudspeaker 160.

Thereafter, there is performed a sequential waveshape data read-out operation in the same way as described above for each generation of the timing pulse TPTN, and accompaniment tones corresponding to the waveshape data $P_2$, $P_3$, . . . , respectively, are sequentially sounded out from the loudspeaker.

When the reading-out of the waveshape data for one whole measure ends, the tempo clock counter 116 generates a second carry-out pulse CO to reset both the address counter 124 and the read-out address counter 148. Accordingly, for the next one measure also, there are read out waveshape data corresponding to the sequential accompaniment tones in the same manner as described above. Thereafter, similar operation is repeated for each measure. Accordingly, automatic accompaniment tones are sounded out from the loudspeaker 160 at the same tempo as of recording.

Now, let us here assume that, in the midst of automatic accompaniment performance in such a way as described above, a different chord whose root note is, for example, F is designated by means of the chord keyboard 132. Whereupon, a chord type designation data CSD corresponding to this designated chord is latched by the chord latch circuit 138 in accordance with the initial timing pulse TPTN, after said different chord has been designated. Accordingly, the frequency of the frequency-divided output pulse coming from the variable frequency divider 140 is now changed to a value corresponding to the root note F of the freshly designated chord. As a result, the stored waveshape of FIG. 14 is read out sequentially at a speed corresponding to the root note F, and accompaniment tones are sounded out sequentially in accordance with the read-out data. In this case, if the accompaniment tone is a chord, there is produced a chord whose root note is F. If, however, in the operation of designating said different chord, the type of chord also has been changed, it should be noted that a train of waveshape data which is to be read out from the waveshape data memory 142 is newly selected according to the chord type which has been designated freshly.

Figure 15A:
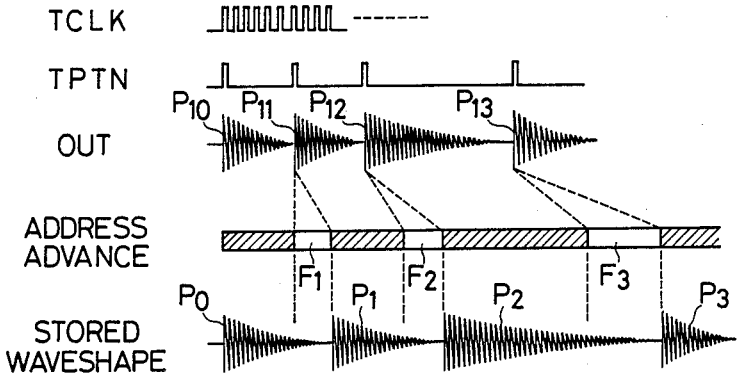
Figure 15B:
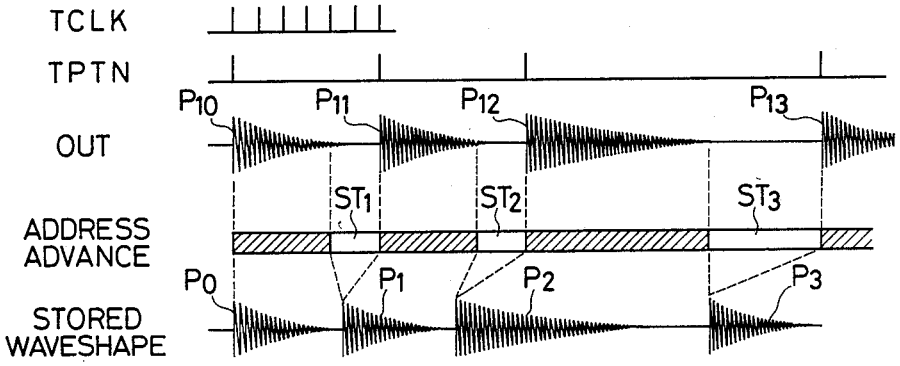

Next, by referring to FIGS. 15A and 15B, description will be made of the accompaniment tone producing operation which differs in the manner of controlling addresses. FIG. 15A shows the operation of an instance which is accompanied by address skipping. Such an operation takes place in the first place when a tempo which is quicker than the tempo of recording is set by means of the tempo setting unit 114, and in the second place when there are designated chords having root notes lower in pitch than G by means of the chord keyboard 132. Likewise, FIG. 15B shows the operation in case the halting of address advancement is involved. Such an operation is performed firstly when a tempo slower than the tempo of recording is set by means of tempo setting unit 114, and secondly when chords having root notes higher than G is designated by the chord keyboard 132.

In the instance of FIG. 15A, there is generated a next timing pulse TPTN before, for example, the waveshape data $P_0$ is read out through to the end address. This applies also to the other waveshape data such as $P_1$, $P_2$, $P_3$, . . . . As a result, the address advancement as viewed at the output side of the adder 128 is such that addresses are skipped at portions such as $F_1$, $F_2$ and $F_3$, and no waveshape data corresponding to the skipped addresses are read out. Accordingly, as the accompaniment tone signal OUT, there will be generated accompaniment tone signals $P_{10}$, $P_{11}$, $P_{12}$, $P_{13}$, . . . sequentially in the form that part of the decay waveshape is blanked out for each accompaniment tone. In this case, the waveshape of the rise portion which is important as a musical tone is reproduced faithfully, so that the degradation of tone quality hardly becomes problematical.

In the instance of FIG. 15B, on the other hand, when, for example, the waveshape data $P_0$ is read out up to the end address the comparator 130 generates a coincidence output EQ to reset the flip-flop 144. In accordance therewith, the counting operation of the read-out address counter 148 is ceased until the generation of a next timing pulse TPTN. This applies also to such waveshape data as $P_1$, $P_2$, $P_3$, . . . . As a result, the address advancement as viewed at the output side of the adder 128 will become halted at the portions such as $ST_1$, $ST_2$, $ST_3$, . . . . Accordingly, as the accompaniment tone signal OUT, there will be generated sequentially accompaniment tone signals $P_{10}$, $P_{11}$, $P_{12}$, $P_{13}$, . . . in such form as will indicate the soundless state after ending of the decay of each accompaniment tone.

In either case of FIGS. 15A and 15B, there will arise no change in the frequency of the frequency-divided output pulse of the variable frequency divider 140 due to the change in the tempo. Accordingly, the read-out speed of waveshape data for each tone will not change, and thus the pitch of the reproduced accompaniment tones will not change in accordance with the change of the tempo.

In case it is intended to stop an automatic accompaniment performance, it is only necessary to turn off the control switch 110. Whereupon, both the tempo clock oscillator 112 and the waveshape data memory 142 are rendered to the disabled state, causing the waveshape data read-out operation to be brought to a halt. Accordingly, the automatic accompaniment performance ceases. Also, such an accompaniment tone producing operation as described above is performed in the same manner with respect also to accompaniment of other types which are selected by means of the accompaniment selection switch 120.

The data adjustment circuit 152 may be comprised of a circuit arrangement similar to that described in connection with FIGS. 1A and 1B, and therefore its detailed explanation is omitted.

In the embodiment of FIGS. 13A and 13B, arrangement is provided to repeat an automatic accompaniment for each single measure. It should be understood, however, that arrangement may be provided so as to repeat the automatic accompaniment for every two measures or for any other desired intervals. Also, arrangement may be made so that the timing pattern memory 122, the address storing means 126 and the waveshape data memory 142 are each comprised of RAM (Random Access Memory) and that necessary data are transmitted from such external recording means 162 such as floppy disk and magnetic tape to the memory 122, the storing means 126 and the memory 142, respectively.

Seventh Embodiment

Figure 16A:
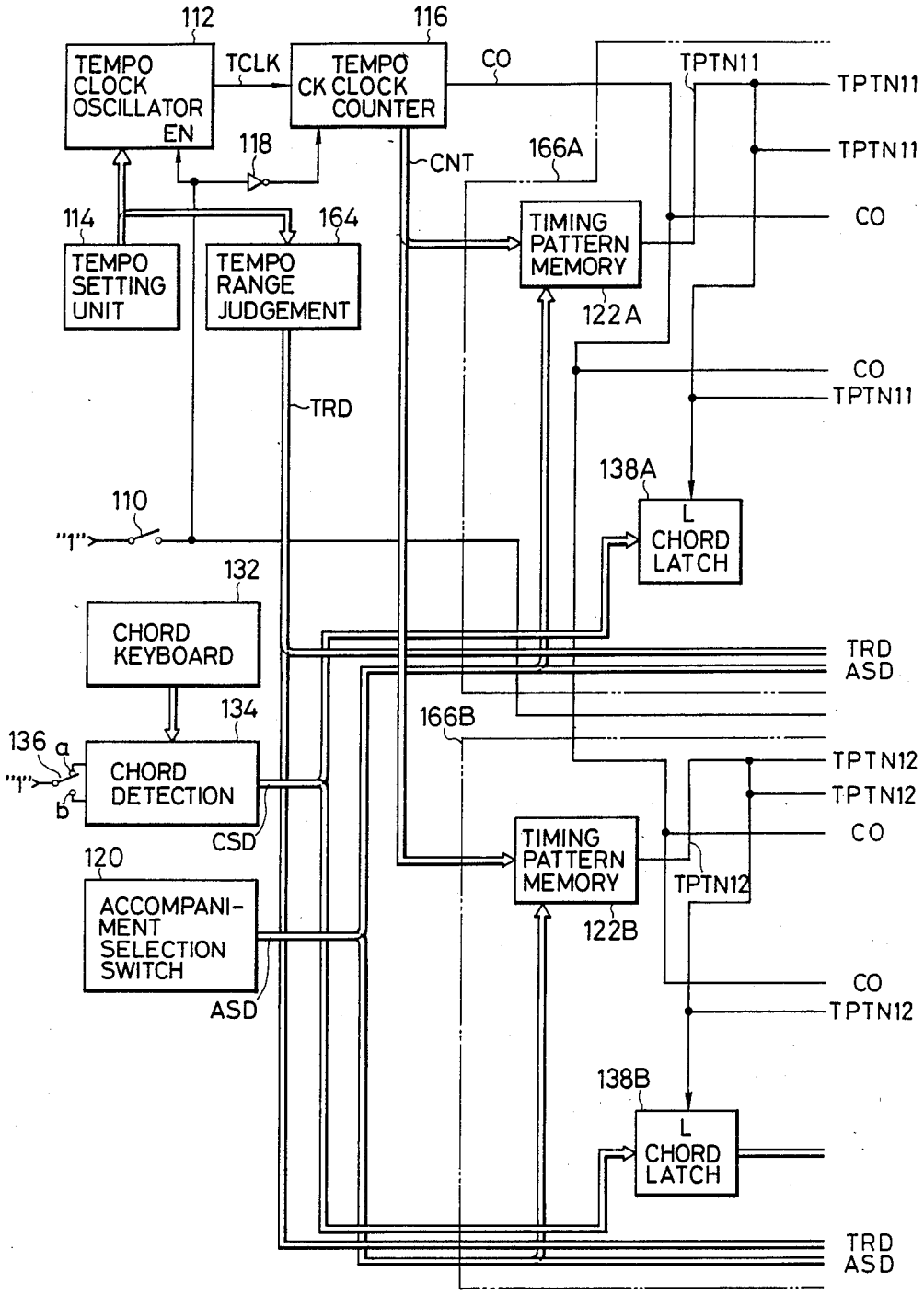
FIGS. 16A, 16B, and 16C in combination are a block diagram showing a tone producing apparatus arranged as an automatic accompaniment apparatus representing a seventh embodiment of the present invention.
Figure 16B:
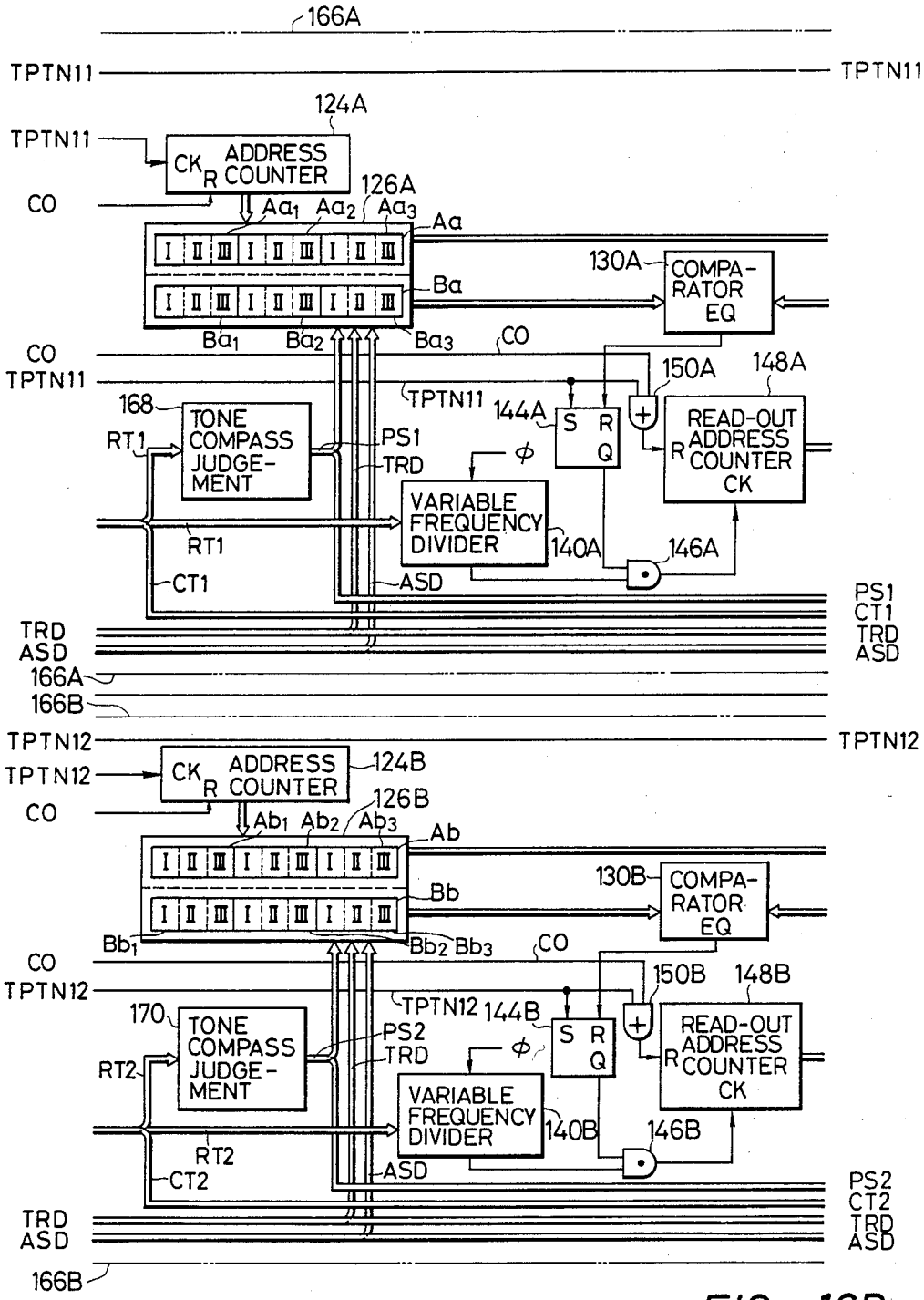
Figure 16C:
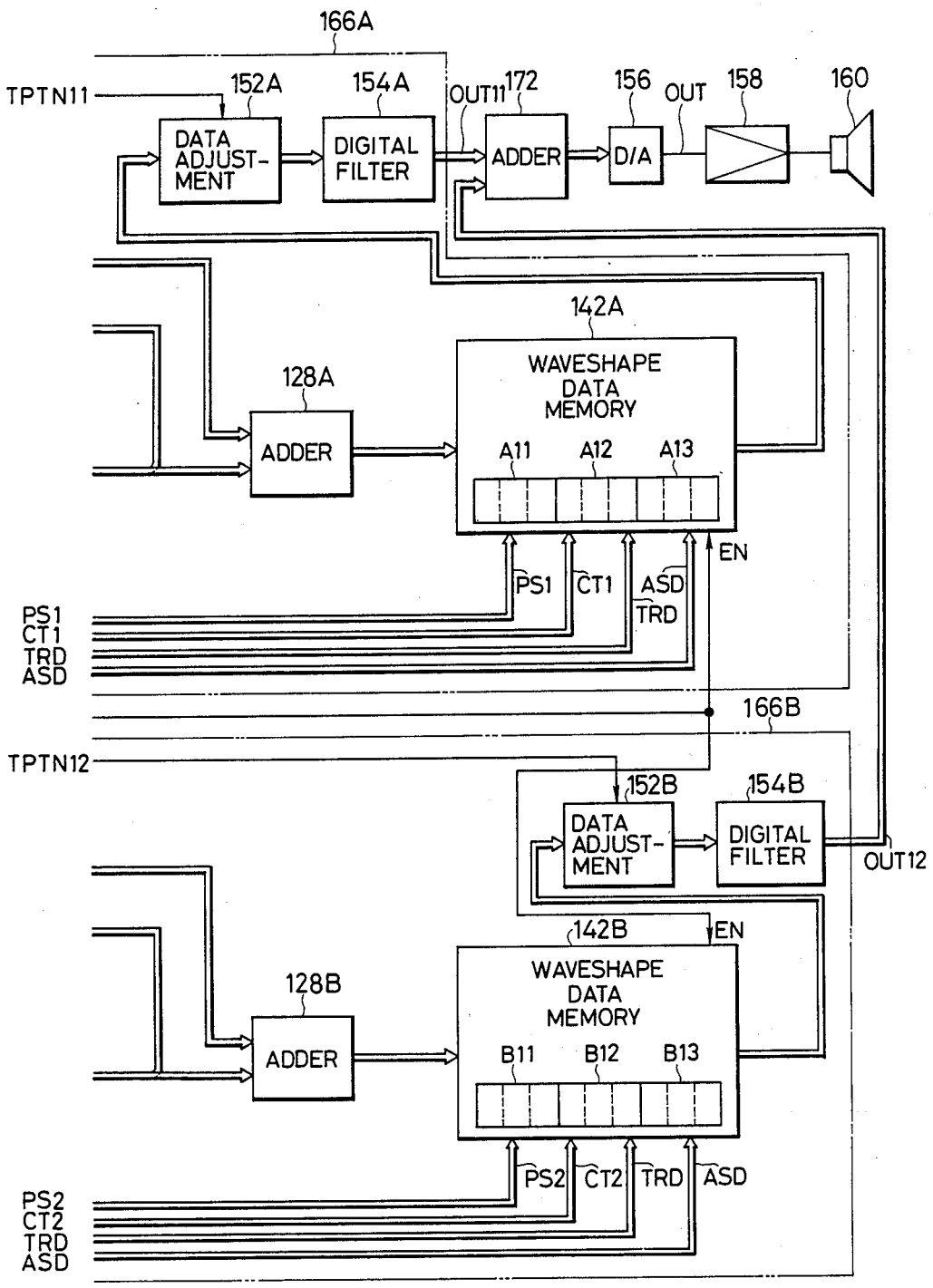

FIGS. 16A, 16B and 16C show in combination a tone producing apparatus arranged as an automatic accompaniment apparatus according to a seventh embodiment of the present invention. Like parts as in FIGS. 13A and 13B are given like reference numerals, and their detailed explanation is omitted.

The apparatus of FIGS. 16A, 16B and 16C has three features. The first feature lies in that, in view of the inconvenience that when the range of tempo variation is broad, this causes the blanked-out portion of waveshape to become large, resulting in a degradation of tone quality, there is provided the arrangement that the range of tempo variation is segmented into a plural sub-ranges, causing the waveshape data to be stored and reproduced for each sub-range of tempo.

The second feature is found in that, in view of the inconvenience that, in case the range of variation of the tone pitch of the root note is wide, the portion of waveshape which is blanked out becomes large and causes a degradation of tone quality, there is provided the arrangement that the range of variation of tone pitch of the root note is segmented into a plurality of tone compasses to insure that waveshape data is stored and reproduced for each tone compass.

The third feature is noted in that in view of the inconvenience that, when a plurality of accompaniment tones are stored in their mixed form, the portion of waveshape which is blanked out becomes large for a bass tone having a long sustain time, causing a degradation of tone quality, there is provided the arrangement that waveshape data is stored and reproduced for bass tone separately from chords and arpeggio tones.

A tempo range judgement circuit 164 judges to which of the predetermined tempo range sections I, II and III the tempo which has been set by the tempo setting unit 114 belongs, and is arranged so that it delivers out a tempo range designation data TRD indicative of the judged tempo range section. As an example, in case the variable tempo range is 60~200 as the number of quarter note per minute, this may be sub-divided into the three tempo range sections I, II and III of 60~99, 100~149 and 150~200.

The first storage and read-out line 166A is intended for chords and arpeggio tones, and the second storage and read-out line 166B is for bass tones. It should be noted here that those blocks in the first and second storage and read out lines 166A and 166B affixed with letters "A" and "B" possess substantially the same functions as those of the blocks of corresponding reference numerals in FIGS. 13A and 13B.

In the first storage and read-out line 166A, a timing pattern memory 122A stores, for each type of accompaniment, a timing pattern indicative of the sequential chord/arpeggio tone producing timing. This timing pattern memory 122A is supplied, as a static address designation signal, an accompaniment type designation data ASD coming from an accompaniment selection switch circuit 120. The timing pattern memory 122A delivers out a sequential timing pulse $TPTN_{11}$ corresponding to the selected type of accompaniment in accordance with the count output CNT coming from a tempo clock counter 116.

An address storing unit 126A possesses a start address memory $A_a$ and an end address memory $B_a$. The start address memory $A_a$ possesses first, second and third storage sections $A_{a1}$, $A_{a2}$ and $A_{a3}$ corresponding to first, second and third tone compasses, respectively. As an example, in case the range of variation of the tone pitch of the root notes extends to 12 notes C, C#, . . . , and B, this range may be sub-divided into three tone sub-compasses to name the first tone compass a range C~D#, the second tone compass a range E~G, and the third tone compass a range G#~B.

The first storage section $A_{a1}$ has three storage blocks corresponding to said three tempo range section I, II and III, respectively. Each storage blocks stores, for each type of accompaniment, a start address data for chord/arpeggio tones which are to be produced sequentially at a tempo falling within the corresponding tempo range and having a root note belonging to the first tone compass. The second storage section $A_{a2}$ has three storage blocks corresponding to the tempo range sections I, II and III, respectively, and each storage block stores, for each type of accompaniment, a start address data for the chord/arpeggio tones which are to be produced sequentially at a tempo falling within the corresponding tempo range having a root note belonging to the second tone compass. The third storage section $A_{a3}$ has three storage blocks corresponding to the tempo range sections I, II and III, respectively, and each storage block stores, for each type of accompaniment, a start address data for chord/arpeggio tones which are to be produced sequentially having a root note belonging to the third tone compass.

The end address memory $B_a$ has first, second and third storage sections $B_{a1}$, $B_{a2}$ and $B_{a3}$ corresponding to the abovesaid first, second and third tone compasses, respectively, and each storage section has three storage blocks corresponding to the abovesaid tempo range sections I, II and III, respectively. Each storage block stores end address data for chord/arpeggio tones in a similar way as for the abovesaid case of start address memory $A_a$.

A chord latch circuit 138A latches a chord type designation data CSD coming from a chord detection circuit 134 in accordance with a timing pulse $TPTN_{11}$. Among the latched data, a root note designation data $RT_1$ is supplied to a variable frequency divider 140A and a tone compass judgement circuit 168, while a chord type designation data $CT_1$ is supplied to a waveshape data memory 142A.

The tone compass judgement circuit 168 judges to which one of the first to third tone compasses the root note indicated by the tone note designation data $RT_1$ belongs. This circuit 168 is arranged to deliver out a tone compass designation data $PS_1$ indicative of the tone compass thus judged. The tone compass designation data $PS_1$ is supplied to the address storing unit 126A and a waveshape data memory 142A.

The address storing unit 126A selects a start address data and an end address data in accordance with a tone compass designation data $PS_1$, a tempo range designation data TRD and an accompaniment type designation data ASD. The selected start address data and end address data are read out in accordance with the count output of an address counter 124A. Let us here assume that the tone compass designation data $PS_1$ indicates the first tone compass, that the tempo range designation data TRD indicates the tempo range section I, and that the accompaniment type designation data ASD indicates a specific type of accompaniment. Then, a start address data corresponding to the specific type of accompaniment is read out from the storage block corresponding to the tempo range section I in the first storage section $A_{a1}$ of the start address memory $A_a$, and concurrently therewith, an end address data corresponding to the specific type of accompaniment is read out from the storage block corresponding to the tempo range section I in the first storage section $B_{a1}$ of the end address memory $B_a$.

The waveshape data memory 142A has first, second and third storage sections $A_{11}$, $A_{12}$ and $A_{13}$ corresponding to the abovesaid first, second and third tone compasses, respectively, and each storage section has three storage blocks corresponding to the abovesaid tempo range sections I, II and III, respectively.

In the first storage section $A_{11}$, each storage block stores, for each type of accompaniment and for each type of chord, waveshape data indicative of the chord/arpeggio tones which are to be sequentially produced and having root notes belonging to the first tone compass, and at a tempo belonging to the corresponding tempo range. In the second storage section $A_{12}$, each storage block stores, for each type of accompaniment and for each type of chord, waveshape data indicative of the waveshapes of the chord/arpeggio tones which are to be produced sequentially at a tempo falling within the corresponding tempo range having root notes belonging to the second tone compass. In the third storage section $A_{13}$, each block stores, for each type of accompaniment and for each type of chord, waveshape data indicative of the waveshapes of the chord/arpeggio tones which are to be produced sequentially at a tempo falling within the corresponding tempo range having root notes which belong to the third tone compass.

In the waveshape data memory 142A, there are selected waveshape data which are to be read out in accordance with a tone compass designation data $PS_1$, a chord type designation data $CT_1$, a tempo range designation data TRD and an accompaniment type designation data ASD. The selected waveshape data are read out in accordance with an address signal coming from an adder 128A in a same way as that described in connection with FIGS. 1A and 1B. For example, if the tone compass designation data $PS_1$ indicates the first tone compass, and the chord type designation data $CT_1$ indicates a specific chord type, the tempo range designation data TRD indicates the tempo range section I, and the accompaniment type designation data ASD indicates a specific type of accompaniment, there are read out from a storage block corresponding to the tempo range section I in the first storage section $A_{11}$ waveshape data corresponding to a specific type of chord and to a specific type of accompaniment at a speed corresponding to the designated root note. In this instance, if only the type of chord is altered such as from C major to C minor on a chord keyboard 132, there are read out from the same storage block the waveshape data corresponding to the freshly designated type of chord.

The waveshape data concerning the sequential chord/arpeggio tones which are read out from the waveshape data memory 142A are supplied to an adder 172 as waveshape data $OUT_{11}$ via a data adjustment circuit 152A and a digital filter 154A.

In the second storage and read-out line 166B, a timing pattern memory 122B stores, for each type of accompaniment, several timing patterns each indicative of sequential bass tone producing timings. This memory 122B is supplied, as a static address designation signal, with an accompaniment type designation data ASD coming from he accompaniment selection switch circuit 120. From a timing pattern memory 122B is delivered out a timing pulse $TPTN_{12}$ corresponding to the selected type of accompaniment, in accordance with a count output delivered from the tempo counter 116.

An address storage section 126B has a start address memory $A_b$ and an end address memory $B_b$. The start address memory $A_b$ has first, second and third storage section $A_{b1}$, $A_{b2}$ and $A_{b3}$ corresponding to the abovesaid first, second and third tone compasses, respectively, and each storage section has three storage blocks corresponding to the abovesaid tempo range sections I, II and III, respectively. Each storage block stores start address data for bass tones in a same way as for the abovesaid start address memory $A_a$.

The end address memory $B_b$ has first, second and third storage sections $B_{b1}$, $B_{b2}$, and $B_{b3}$ corresponding to the first, second and third tone compasses, respectively. Each storage section has three storage blocks corresponding to the tempo range sections I, II and III, respectively. Each storage block stores end address data for bass tones in a same way as for the abovesaid start address memory $A_a$.

A chord latch circuit 138B latches a chord type designation data CSD coming from a chord detection circuit 134 in accordance with a timing pulse $TPTN_{12}$. Among the latched data, the root note designation data $RT_2$ is supplied to a variable frequency divider 140B and a tone compass judgement circuit 170, while a chord type designation data $CT_2$ is supplied to a waveshape data memory 142B.

The tone compass judgement circuit 170 judges to which one of the first to third tone compasses the root note indicated by the root note designation data $RT_2$ belongs, and it is arranged to deliver out a tone compass designation data PS2 indicative of the thus judged tone compass. The tone compass designation data PS2 is supplied to an address storage section 126B and to a waveshape data memory 142B.

The address storage section 126B selects start address data and end address data which are to be read out in accordance with a tempo range designation data TRD and an accompaniment type designation data ASD. The selected start address data and end address data are read out in accordance with the count output of an address counter 124B. For example, if the tone compass designation data $PS_2$ indicates the first tone compass, the tempo range designation data TRD indicates the tempo range section I, and the accompaniment type designation data ASD indicates a specific type of accompaniment, there is read out start address data corresponding to the specific type of accompaniment from the storage block corresponding to the tempo range section I in the first storage section $A_{b1}$ of the address memory $A_b$, and concurrently therewith there is read out end address corresponding to the specific type of accompaniment from the storage block corresponding to the tempo range section I in the first storage section $B_{b1}$ of the end address memory $B_b$.

The waveshape data memory 142B has first, second and third storage sections $B_{11}$, $B_{12}$ and $B_{13}$ corresponding to the abovesaid first, second and third tone compasses, respectively. Each storage section has three storage blocks corresponding to the abovesaid tempo range sections I, II and III, respectively.

In the first storage section $B_{11}$, each storage block stores, for each type of accompaniment and for each type of chord, waveshape data indicative of the waveshapes of bass tones which are to be sequentially produced in connection with the root notes which belong to the first tone compass and at a tempo belonging to the corresponding tempo range. In the second storage section $B_{12}$, each block stores, for each type of accompaniment and for each type of chord, waveshape indicative of the waveshapes of bass tones which are to be sequentially produced at a tempo belonging to the corresponding tempo range and in connection with the root notes belonging to the second tone compass. In tee third storage section $B_{13}$, each storage block stores, for each type of accompaniment and for each type of chord, waveshape data indicative of the waveshapes of bass tones which are to be sequentially produced at a tempo belonging to the corresponding tempo range and in connection with the root notes belonging to the third tone compass.

In the waveshape data memory 142B, there are selected waveshape data which are to be read out in accordance with a tone compass designation data $PS_2$, a chord type designation data $CT_2$, a tempo range designation data TRD, and an accompaniment type designation data ASD. The selected waveshape data are read out in accordance with an address signal coming from an adder 128B in a same way as described in connection with FIGS. 13A and 13B. If, for example, the tone compass designation data $PS_2$ indicates the first tone compass, the chord type designation data $CT_2$ indicates a specific type of chord, the tempo range designation data TRD indicates the tempo range section I, and the accompaniment type designation data ASD indicates a specific type of accompaniment, there is read out at a speed corresponding to the designated root note a waveshape data corresponding to the specific type of chord and to the specific type of accompaniment from a storage block corresponding to the tempo range section I in the first storage section $B_{11}$. In this case, if, on the chord keyboard 132, only the chord type is altered such as from C major to C minor, there is read out from the same storage block a waveshape data corresponding to the freshly designated type of chord.

The waveshape data representing the sequential bass tones read out from the waveshape data memory 142A are supplied, as a waveshape data $OUT_{12}$, to an adder 172 via a data adjustment circuit 152B and a digital filter 154B.

The adder 172 adds up the waveshape data $OUT_{11}$ and $OUT_{12}$ and supplies the resulting data to D/A converter circuit 156. As a result, from this D/A converter circuit 156 are sequentially delivered out accompaniment tone signals OUT in a same way as for the instance of FIGS. 1A and 1B. And, from a loudspeaker 160 are sounded out automatic accompaniment tones in accordance with the sequential accompaniment tone signals OUT.

In the embodiment of FIGS. 16A, 16B and 16C, as the waveshape data which are to be stored in the waveshape data memories 142A and 142B, there can be used digital waveshape data indicative of the sample values of the continuous waveshapes for each accompaniment tone from its rise up through to immediately before the rise of the next accompaniment tone as in the case of FIGS. 1A and 1B. With respect to such tones as bass tones having a small frequency of occurrence, however, there may be provided an arrangement that, by storing in the memory a digital waveshape data indicative of the waveshape sample values from the rise up to the decay for each tone, and by controlling the interruption of the read-out operation of the waveshape data, the soundless states are reproduced. By so doing, there can be avoided a need to store in the memory the waveshape data corresponding to the soundless state, so that it is possible to reduce the capacity of memory.

Figure 17:
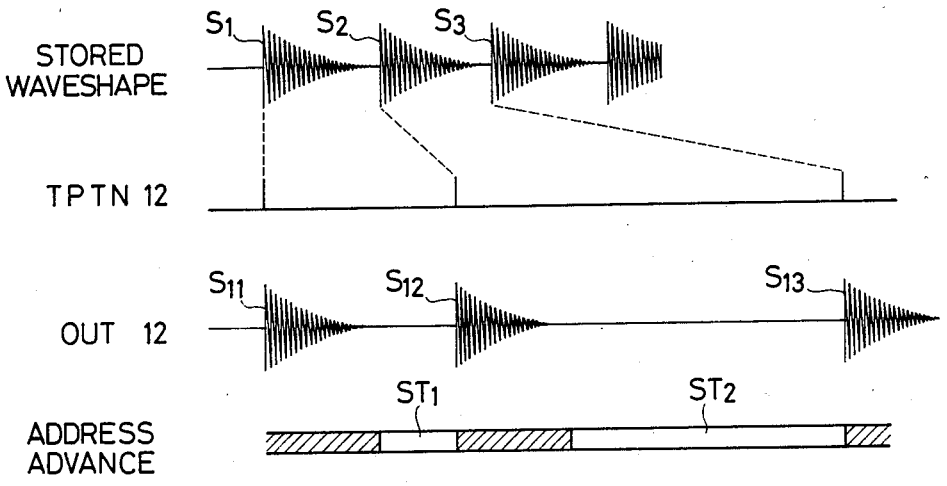
FIG. 17 is a time chart for explaining the bass tone producing operation of the apparatus of FIGS. 16A plus 16B plus 16C.

FIG. 17 is intended to explain the bass tone producing operation in the instance wherein, as the bass tone waveshape data, digital waveshape data indicative of the sample values of the waveshape from the rise up to the decay of each bass tone are stored in the waveshape data memory 142B.

In the waveshape data memory 142B, let us assume that such waveshape data $S_1$, $S_2$, $S_3$, . . . indicative of such stored waveshapes as shown in FIG. 17 are selected for being read out in accordance with the tone compass designation data $PS_2$, the chord designation data CT2, the tempo range designation data TRD and the accompaniment type designation data ASD. In FIG. 17, the waveshape data $OUT_{12}$ and $S_1$, $S_2$, $S_3$, . . . are shown in the form of analog signals for the sake of convenience.

When a flip-flop 144B is set in accordance with the initial timing pulse $TPTN_{12}$, a read-out address counter 148B delivers out sequentially an address signal so as to indicate an address value which increases at a speed corresponding to the designated root note. Accordingly, from the waveshape data memory 142B are read out waveshape data $S_1$ constituting the first bass tone. As the waveshape data $OUT_{12}$, there are delivered out data representing the first bass tone signal $S_{11}$.

Thereafter, when the value of the address signal coming from the read-out address counter 148B coincides with the end address value indicated by the end address data coming from the end address memory $B_b$, a comparator 130B generates a coincidence output EQ to reset the flip-flop 144B. Accordingly, the read-out address counter 148B ceases its counting operation. And, the address advancement as viewed at the output side of the adder 128B ceases for the length of time $ST_1$ until the generation of the next timing pulse $TPTN_{12}$ as shown in FIG. 17. By not reading out data from the waveshape data memory 142B during this read-out interruption period $ST_1$, there is reproduced a soundless state from the end of decay of the first bass tone signal $S_{11}$ until immediately before the rise of the second bass tone signal $S_{12}$.

Next, when the second timing pulse $TPTN_{12}$ is generated, waveshape data $S_2$ representing the second bass tone are sequentially read out from the waveshape data memory 142B in a same way as that described above. As the waveshape data $OUT_{12}$, data corresponding to the second bass tone signal $S_{12}$ are delivered out.

Thereafter, the read-out address counter 148B ceases its counting operation upon coincidence with the end address for the second bass tone as in the case described above. The period $ST_2$ of this interruption continues until generation of a third timing pulse $TPTN_{12}$. And, in accordance with the third timing pulse $TPTN_{12}$, there is read out waveshape data S3, so that, as the waveshape data $OUT_{12}$, there are delivered out data constituting third bass tone signal $S_{13}$. Thereafter, operation such as mentioned above are repeated. Accordingly, bass tones corresponding to the bass tone signals $S_{11}$, $S_{12}$, $S_{13}$, . . . are sounded out from the loudspeaker 160.

Eighth Embodiment

Figure 18A:
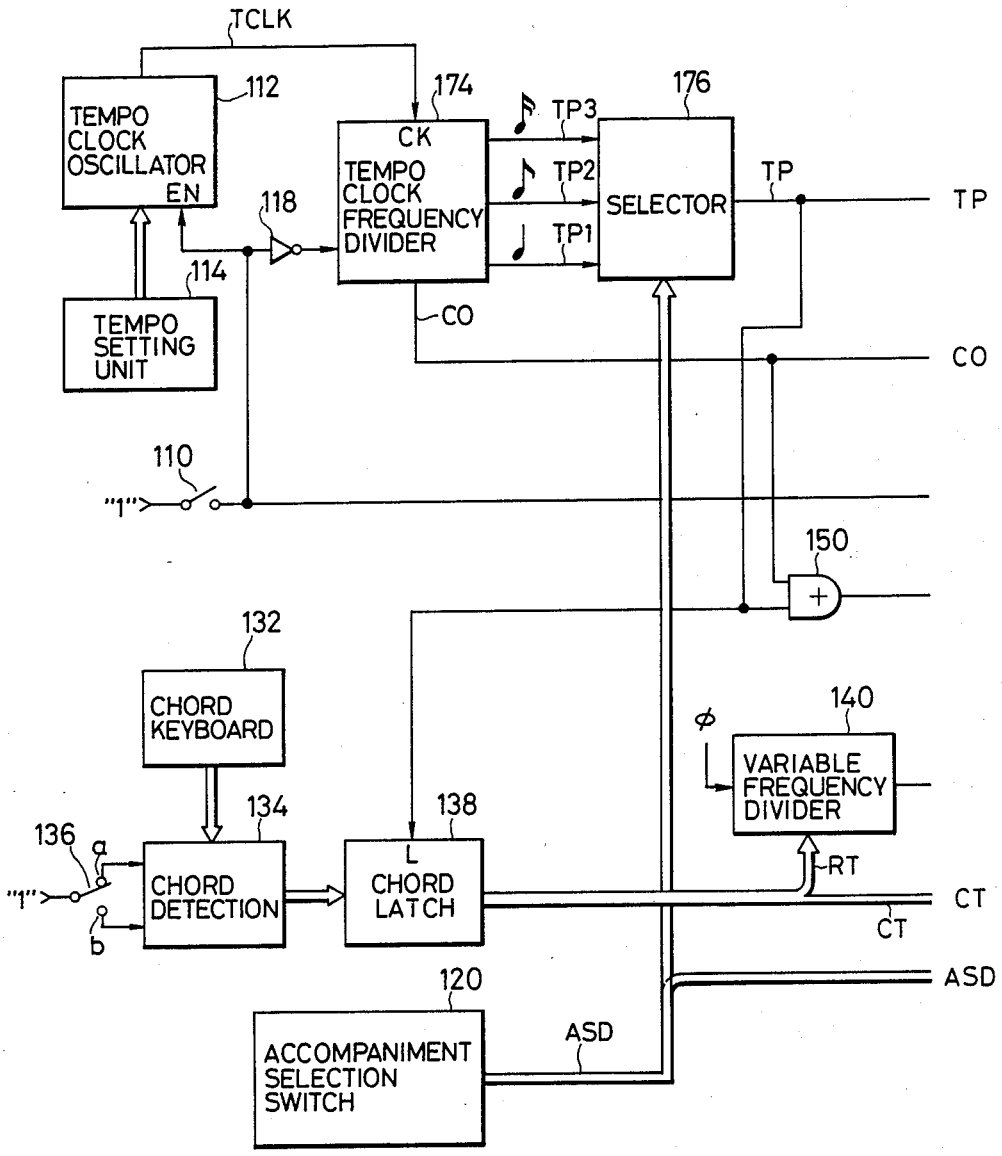
FIGS. 18A and 18B are a block diagram showing a tone producing apparatus arranged as an automatic accompaniment apparatus representing an eighth embodiment of the present invention.
Figure 18B:
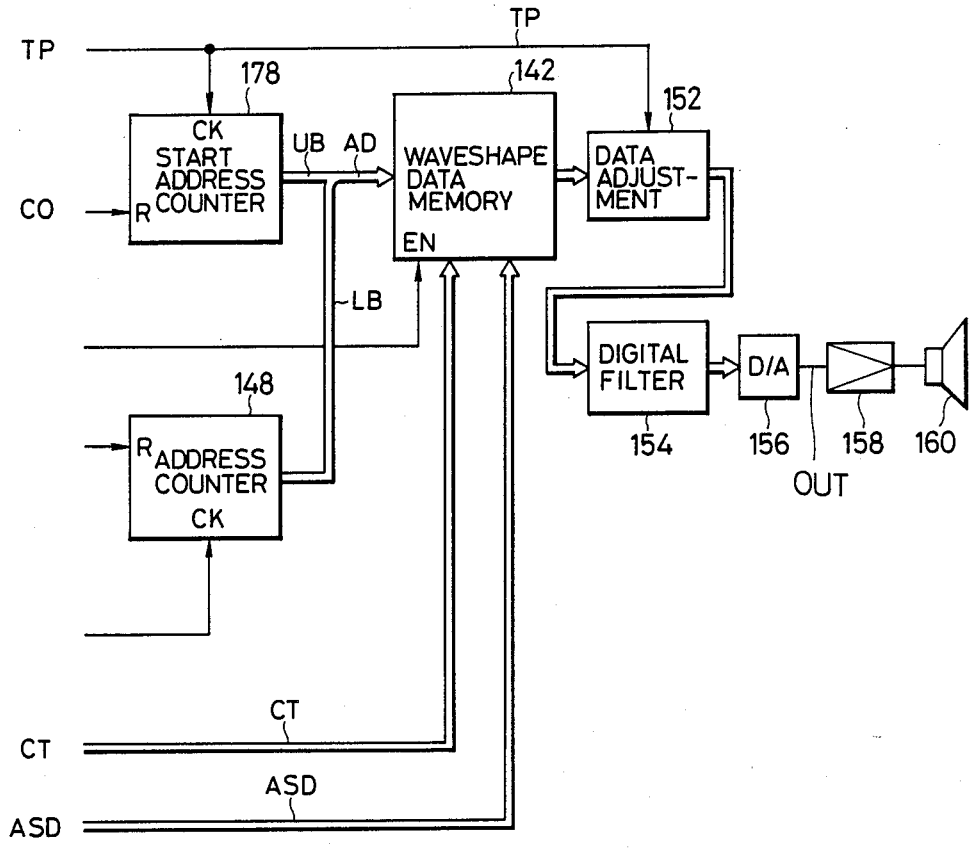

FIGS. 18A and 18B show in combination a tone producing apparatus arranged as an automatic accompaniment apparatus according to an eighth embodiment of the present invention. Like parts as in FIGS. 13A and 13B are given like reference numerals, and their detailed explanation is omitted.

The feature of the apparatus of FIGS. 18A and 18B lies in that the arrangement of the waveshape data read-out circuit is simplified by using a frequency divider, a counter and the like to meet the requirement that, depending on the type of accompaniment pattern, there may only be a need of producing accompaniment tones at a constant cycle, similarly as in case of FIGS. 10A and 10B.

A tempo frequency divider 174 is comprised of a counter for dividing the frequency of the tempo clock pulse TCLK coming from a tempo oscillator 112. This tempo frequency divider 174 is arranged so that it generates timing pulses $TP_1 \sim TP_3$ of the first to the third lines, and also it generates a carry-out pulse CO when a control switch 110 is turned on and also for each measure. The timing pulse $TP_1$ of the first line is generated repeatedly at a time interval corresponding to a quarter note. The timing pulse $TP_2$ of the second line is generated repeatedly at a time interval corresponding to an eighth note. The timing pulse $TP_3$ of the third line is generated repeatedly at a time interval corresponding to a sixteenth note.

A selector circuit 176 is arranged to select and deliver a timing pulse of either one line among the timing pulses $TP_1 \sim TP_3$ of the first to the third lines, in accordance with an accompaniment type designation data ASD coming from an accompaniment selection switch circuit 120.

The timing pulse TP which is delivered out from the selector circuit 176 acts in the same way as the timing pulse TPTN which has been described in connection with FIGS. 13A and 13B. The timing pulse TP is supplied to an OR gate 150, a start address counter 178 and a data adjustment circuit 152.

The start address counter 178, after being reset in accordance with an initial carry-out pulse CO which is generated at the time the control switch 110 is turned on, counts the timing pulse TP, and delivers out start address data sequentially. And, the resetting and counting operation similar to those mentioned above are repeated for each generation of the second and subsequent carry-out pulses CO.

An address signal AD for reading out waveshape data from a waveshape data memory 142 is such that its upper bits UP are comprised of a start address data coming from the start address counter 178 and that its lower bits LB are comprised of an address signal coming from a readout address counter 148. Accordingly, from the waveshape data memory 142 are read out sequentially waveshape data for the sequential accompaniment tones at read-out start timings which are synchronous with the timing pulses TP and at a speed corresponding to the designated root note.

In the apparatus of FIGS. 18A and 18B mentioned above, there is not provided a read-out cease control section unlike the instance of FIGS. 13A and 13B. Accordingly, this apparatus of FIGS. 18A and 18B has no other functions excepting quickening the tempo than the recording tempo and lowering the read-out speed. As such, as the waveshape data stored in the waveshape data memory 142, there are employed data such that the tempo is slowed down as much as possible and that recording is made digitally for the root note of B.

In the embodiment mentioned above, it should be noted that, as the stored waveshape data, there have been used digital words indicative of the sample values of waveshapes. It should be understood, however, that, in place of the above-mentioned construction, there may be provided an arrangement that there may be used digital words which indicate the differences (i.e. increments) of amplitudes of the signal at respective adjacent sample points of each waveshape, to reproduce a waveshape signal by virtue of the processing by arithmetic operation.

What is claimed is:

1. An apparatus for producing rhythmically aligned tones from stored wave data comprising:

memory means for storing wave data representing a train of said rhythmically aligned tones in sequence to be successively sounded at different times to constitute a predetermined length of musical progression, said memory means including a plurality of memory areas which store each of said tones respectively, each of said memory areas being divided into memory portions for storing wave sample data representing each of said tones;

area designating means for sequentially designating areas to read out said train of tones in a rhythmic pattern to constitute said musical progression having a tempo;

read-out speed determining means for determining a speed of reading said wave sample data out of said memory portions within said designated area; and read-out means for reading out said wave sample data from said memory portions in said designated area at the speed determined by said read-out speed determining means.

2. An apparatus according to claim 1, further comprising:

tempo setting means for setting said tempo.

3. An apparatus according to claim 1, in which:

said area designating means comprises a memory which stores designating data for designating said areas.

4. An apparatus according to claim 1, in which:

said area designating means further comprises:

storing means to store timings for constituting said rhythmic pattern, and pulse generating means for reading out said timings from said storing means to generate timing pulses for designating said areas.

5. An apparatus according to claim 3, in which:

said designating data contains data representing a starting position and an ending position for each of said designated areas.

6. An apparatus according to claim 1, in which: said area designating means has pulse generating means for generating a plurality of different timing pulses based on said tempo, and pattern pulse forming means for forming timing pulses having a pattern by combining said different timing pulses.

7. An apparatus according to claim 1, further comprising:

data adjustment means for adjusting partially the data received from said memory means, and for delivering out the partially adjusted data.

8. An apparatus according to claim 2, further comprising:

tempo range judging means for judging to which one of a plurality of predetermined tempo ranges a tempo set by said tempo setting means belongs, and for delivering out a tempo range designation data indicative of a judged tempo range; and in which:

said memory means stores a plurality of said trains of tones corresponding to said plurality of predetermined tempo ranges, and said area designating means designates areas to read out a train of tones being selected from among said trains of tones in accordance with said tempo range designation data.

9. An apparatus according to claim 4, further comprising:

rhythm selecting means for selecting rhythm; and in which:

said train of tones are percussion instrument tones constituting a rhythm section of a musical performance, and said timings constitute a rhythm selected by said rhythm selecting means.

10. An apparatus according to claim 1, in which:

at least one of said tones is a combination of waveshapes of tones of a plurality of different musical instruments.

11. An apparatus according to claim 1, further comprising:

tonality setting means for setting a tonality; and in which:

said memory means stores a train of tones constituting a chord accompaniment of a certain tonality, and said read-out speed determining means determining a read-out speed so that the train of tones thus read out exhibits the set tonality.

12. An apparatus according to claim 11, further comprising:

tonality range judging means for judging to which one of a plurality of predetermined tonality ranges a tonality set by said tonality setting means belongs, and for delivering out a tonality range designation data indicative of a tonality range thus judged; and in which:

said memory means stores a plurality of said trains of tones corresponding to said plurality of predetermined tonality ranges, and said area designating means designates areas to read out a train of tones being selected from among said trains of tones in accordance with said tonality range designating data.

13. An apparatus for producing rhythm tones at a rhythm tempo rate, comprising:

memory means for storing a series of waveshapes representing an alignment of sequential rhythm tones to be produced;

readout means for reading out said waveshapes from said memory means in sequence of the alignment according to rhythm timings and at a readout rate selected such that said read out waveshaped are of the same pitch independent of said tempo rate.

14. An apparatus for producing rhythm tones at a rhythm tempo rate, comprising:

memory means for storing a series of waveshapes representing an alignment of sequential rhythm tones to be produced;

readout means for reading out said waveshapes from said memory means in sequence of the alignment according to rhythm timings, such that in the event that at a given rhythm timing the readout of the previous waveshape is not completed, the remaining non-readout portion of said previous waveshape is skipped and the beginning of the next succeeding stored waveshape is read out.

15. An apparatus according to claim 14 wherein the readout means reads out said waveshapes at a readout rate selected such that said read out waveshapes have a pitch independent of the rhythm tempo rate.

* * * * *

UNITED STATES PATENT AND TRADEMARK OFFICE

CERTIFICATE OF CORRECTION

PATENT NO. : 4,876,937

DATED : 10/31/89

INVENTOR(S) : HIDEO SUZUKI

It is certified that error appears in the above-identified patent and that said Letters Patent is hereby corrected as shown below:

Col. 38, In claim 8, line 6, before "tempo", delete "a".

Signed and Sealed this

Third Day of December, 1991

*Attest:*

HARRY F. MANBECK, JR.

*Attesting Officer*

*Commissioner of Patents and Trademarks*